US005588284A

United States Patent [19]

Klover et al.

[11] Patent Number: 5,588,284

[45] Date of Patent: Dec. 31, 1996

[54] METHOD AND APPARATUS FOR PACKING A PLURALITY OF ARTICLES IN CARTONS

[75] Inventors: John M. Klover, Canton; Philip F. Hamrick, Atwater, both of Ohio

[73] Assignee: Hamrick Manufacturing & Service, Inc., Mogadore, Ohio

[21] Appl. No.: 419,423

[22] Filed: Apr. 10, 1995

[51] Int. Cl.[6] ..... B65B 5/10; B65B 21/10

[52] U.S. Cl. ..... 53/534; 53/249; 53/257; 53/475

[58] Field of Search ..... 53/475, 473, 448, 53/443, 244, 534, 257, 255

[56] References Cited

U.S. PATENT DOCUMENTS

| | | | |
|---|---|---|---|
| 3,601,952 | 8/1971 | Cato | 53/249 X |
| 4,642,967 | 2/1987 | Culpepper | 53/534 X |
| 4,901,501 | 2/1990 | Raudat et al. | 53/534 X |
| 5,020,306 | 6/1991 | Raudat | 53/534 |
| 5,197,261 | 3/1993 | Hartness et al. | 53/534 |
| 5,212,930 | 5/1993 | Raudat | 53/263 |
| 5,241,805 | 9/1993 | Johnson | 53/534 |
| 5,491,959 | 2/1996 | Jenne | 53/534 |

*Primary Examiner*—James F. Coan

*Attorney, Agent, or Firm*—Renner, Kenner, Greive, Bobak, Taylor & Weber

[57] ABSTRACT

A method and apparatus for continuously packing a plurality of articles into receiving cartons. A loading station is utilized in combination with a carton feeding queue for delivering a continuous sequence of cartons to the loading station. A mechanism is provided to transport the cartons along the carton feeding queue and to maintain at least the next successive carton in the queue in continuous longitudinal engagement with any carton at the loading station. An article orienting and delivery queue is employed for longitudinally aligning a plurality of articles in the desired longitudinal, end-to-end, and lateral, side-by-side, relationship. A slide portion of the article orienting and delivery queue is inclined to permit the articles longitudinally to traverse the slide portion and to be received at the loading station by gravity. A transfer device is provided at the discharge end of the loading head to support the articles as they continue to descend by gravity and engage the carton at the loading station. The descending engagement of the articles with the carton at the loading station as the articles move along the transfer device effects synchronous movement of the carton with the articles at the loading station to permit continuous deposit of the articles within the successive cartons. A flight mechanism is also provided longitudinally to space the articles on the transfer mechanism in a predetermined grouping for drivingly engaging the carton at the loading station and for depositing the articles in the carton as they traverse the loading station with a suitable spacing between the groups of articles in order to assure the desired engagement with the next successive carton entering upon the loading station.

19 Claims, 20 Drawing Sheets

METHOD AND APPARATUS FOR PACKING A PLURALITY OF ARTICLES IN CARTONS

TECHNICAL FIELD

The present invention relates generally to "case loaders," or, as they are, perhaps, more commonly identified in the industry, "case packers." More particularly, the present invention relates to the packing, or loading, of a plurality of laterally, and longitudinally, aligned articles into appropriate cartons, or cases. Specifically, the present invention relates to a method and apparatus for continuously packing, under the controlled influence of gravity, a plurality of articles in the nature of containers such as bottles, or the like, into a sequential plurality of cartons, or cases—even if the cartons are provided with individual pockets within which each article is to be received.

BACKGROUND OF THE INVENTION

Apparatus and machinery for automatically packing either individual, or a plurality of, articles in the nature of bottles, or other containers, in one or more cases, or cartons, have long been known to the art, and such machines incorporate a wide variety of configurations for operating according to a fairly limited number of procedures.

For example, continuous motion packers adapted to load two laterally disposed files, or columns, of relatively large bottles into upwardly open cases, or cartons, are disclosed in U.S. Pat. Nos. 4,901,501 and 5,020,306—both of which are assigned to Standard-Knapp, Inc.—but neither of those patents disclose or suggest how one might load more than two columns of side-by-side containers having upwardly facing pockets. When a plurality of containers are to be received in cartons having a plurality of pockets one approach has been to employ what is commonly known as a "drop packer." That is, the containers, or bottles, are dropped through a grid into the cases that are positioned beneath the bottles.

The drop packer apparatus has heretofore had two requirements that not only slow the packing procedure but also require complicated machinery to accomplish its objective. Drop packers typically require: (1) that the bottles must be dropped; and, (2) that absolute synchronization between the location of the bottles and the location of the receiving cartons must be achieved. The drop distance is typically minimized by employing elevators that either raise the receiving carton—as shown in U.S. Pat. No. 5,241,805—or lower the bottle to a minimal drop distance—as shown in U.S. Pat. No. 5,212,930. Both of the aforesaid prior art patents issued to Standard-Knapp, Inc.

Even aside from the drop packers, the prior art has heretofore focused on the means by which to effect synchronization of the bottles relative to the receiving carton, and such focus has involved relatively complex interactions between the containers, or bottles, and the cartons within which the containers are to be received. Perhaps the most simplified arrangement is that shown in the previously identified U.S. Pat. No. 5,241,805 wherein a mechanism is incorporated to lift at least one end of the receiving carton so as to minimize the drop distance and at the same time effect control over the longitudinal movement of the carton in order to achieve synchronization between the longitudinal location of the carton relative to the bottles.

U.S. Pat. No. 5,197,261—issued to Hartness International, Inc.—has secured synchronization by driving the cartons at a predetermined speed and allowing the containers to slide, by gravity, down a slide where the shoulders of the containers are engaged by elongate members that drive the containers into the cases. The rate at which the cases are loaded is determined by the preselected speed at which the cases are delivered to the loading zone. The successive containers are precluded from spilling out of the loading mechanism simply by the presence of the containers previously deposited in the case positioned at the loading zone which serve to block the successive containers from falling off the slide. In the event a case is not timely delivered to the loading station the containers will fall onto the loading zone.

SUMMARY OF THE INVENTION

It is, therefore, a primary object of the present invention to provide a novel and improved method and apparatus for continuously packing a plurality of laterally, and longitudinally, aligned articles in the nature of containers, such as bottles, into receiving cartons wherein the articles and the cartons are delivered to a loading station along vertically displaced queues in such a manner that the longitudinally moving articles engage the cartons in which they are being loaded in order to control the longitudinal movement of the carton at the loading station and thereby effect the desired synchronization between the articles and the cartons to achieve controlled insertion of the articles into their respective cartons. That is, regulation and timing of the system is accomplished without mechanical or electrical synchronization between the stream of articles and the cartons, but solely by the drive pressure of the article stream as that stream moves into contact with the cartons at the loading station.

It is another object of the present invention to provide an improved method and apparatus for continuously packing a plurality of articles into receiving cartons, as above, wherein the articles not only move the cartons but are also inserted into their individual cases under the controlled influence of gravity.

It is a further object of the present invention to provide an improved method and apparatus for continuously packing a plurality of articles into receiving cartons, as above, wherein a brake is employed in conjunction with a flight chain mechanism to preclude longitudinal movement of the articles along a transfer means during start-up adjustment. The flight chain mechanism is readily replaceable to adjust for article and carton sizes. The flight chain mechanism incorporates bars that are capable of effecting longitudinal article spacing in desired group sizes for fitting into successive cartons, even when the articles are, themselves, relatively soft or flexible.

It is still another object of the present invention to provide an improved method and apparatus for continuously packing a plurality of articles into receiving cartons, as above, wherein a transfer means effects the desired support and orientation of the articles in preparation for deposit in the carton.

It is yet another object of the present invention to provide an improved method and apparatus for continuously packing a plurality of articles into receiving cartons, as above, wherein an article loading head may be manually replaced and may be provided with laterally adjustable lane guides to accommodate for both the number of articles to be loaded in laterally disposed, side-by-side relation as well as for the size of the articles.

It is a still further object of the present invention to provide an improved method and apparatus for continuously packing a plurality of articles into receiving cartons, as above, wherein the article loading head is removably secured to a delivery slide assembly that is vertically adjustable, about a pivot point, to select the inclination of the slide assembly and the article loading head in order not only to facilitate the change-over for articles of different heights but also to provide access for clearing of any possible jamming of the articles, or cartons, in transit within the loading head, at the loading station or beneath the slide assembly.

These and other objects of the invention, as well as the advantages thereof over existing and prior art forms, which will be apparent in view of the following detailed specification, are accomplished by means hereinafter described and claimed.

In general, a method and apparatus for continuously packing a plurality of articles into receiving cartons and which embody the concepts of the present invention utilizes a loading station in combination with a carton queue for delivering a continuous sequence of cartons to the loading station. A mechanism is provided to transport the canons along the carton delivery queue and to maintain at least the next successive carton in the queue in continuous longitudinal engagement with any carton at the loading station.

An article orienting and delivery queue is employed for longitudinally aligning a plurality of articles in the desired longitudinal, end-to-end, and lateral, side-by-side, relationship. An inclined slide assembly is incorporated in the article orienting and delivery queue to permit the articles longitudinally to traverse the slide, pass through the loading head and be received at the loading station by gravity. A transfer device is incorporated in the loading head to support the articles as they descend, by gravity, into engagement with a carton at the loading station.

The descending engagement of the articles with the carton at the loading station as the articles move along the transfer device effects synchronous movement of the carton with the articles being delivered to the loading station by gravity in order to assure a continuous deposit of the articles into the cat ton. A flight mechanism is also provided longitudinally to space the articles on the transfer mechanism in a predetermined grouping, or orientation, for depositing the articles in the successive cartons presented at the loading station.

To acquaint persons skilled in the art most closely related to the present invention, one preferred embodiment of an apparatus for continuously packing a plurality of articles into receiving cartons that illustrates not only a best mode now contemplated for putting the apparatus into practice but also for demonstrating the method described herein by, and with reference to, the annexed drawings that form a part of the specification. The exemplary method and apparatus for continuously packing a plurality of articles into receiving cartons is described in detail without attempting to show all of the various forms and modification in which the invention might be embodied. As such, the embodiment shown and described herein is illustrative, and as will become apparent to those skilled in this art, can be modified in numerous ways within the spirit and scope of the invention; the invention being measured by the appended claims and not by the details of the specification.

BRIEF DESCRIPTION OF THE DRAWINGS

FIG. 16 is taken substantially along line 16—16 of FIG. 17;

DESCRIPTION OF AN EXEMPLARY EMBODIMENT

One representative form of an apparatus for continuously packing a plurality of articles into receiving cartons and embodying the concepts of the present invention is designated generally by the numeral 10 on the accompanying drawings. The representative packing apparatus 10 also operates according to the unique method of the present invention.

Figure 1:
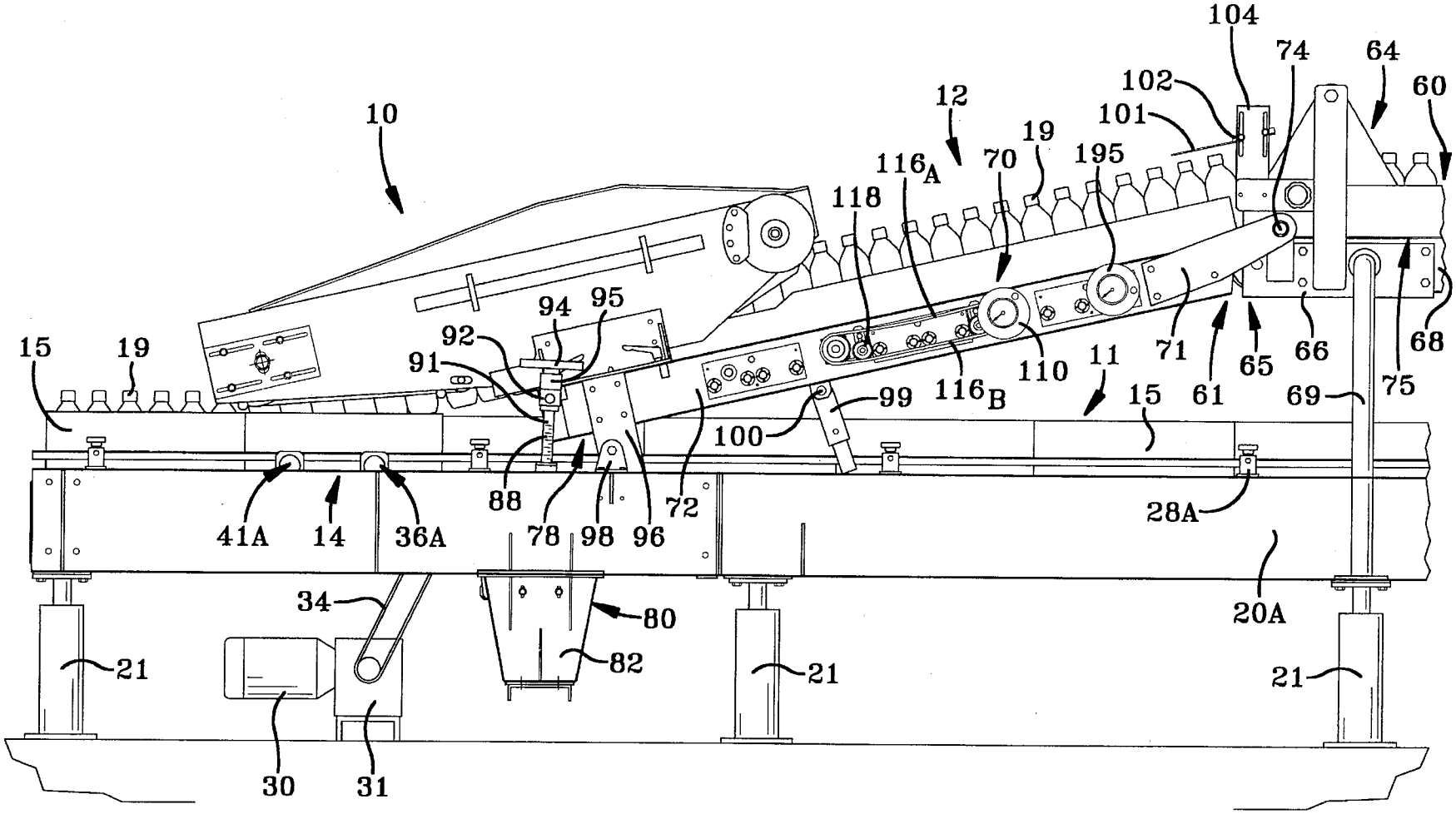
FIG. 1 is a side elevation of a packing apparatus embodying the concepts of the present invention.
Figure 2:
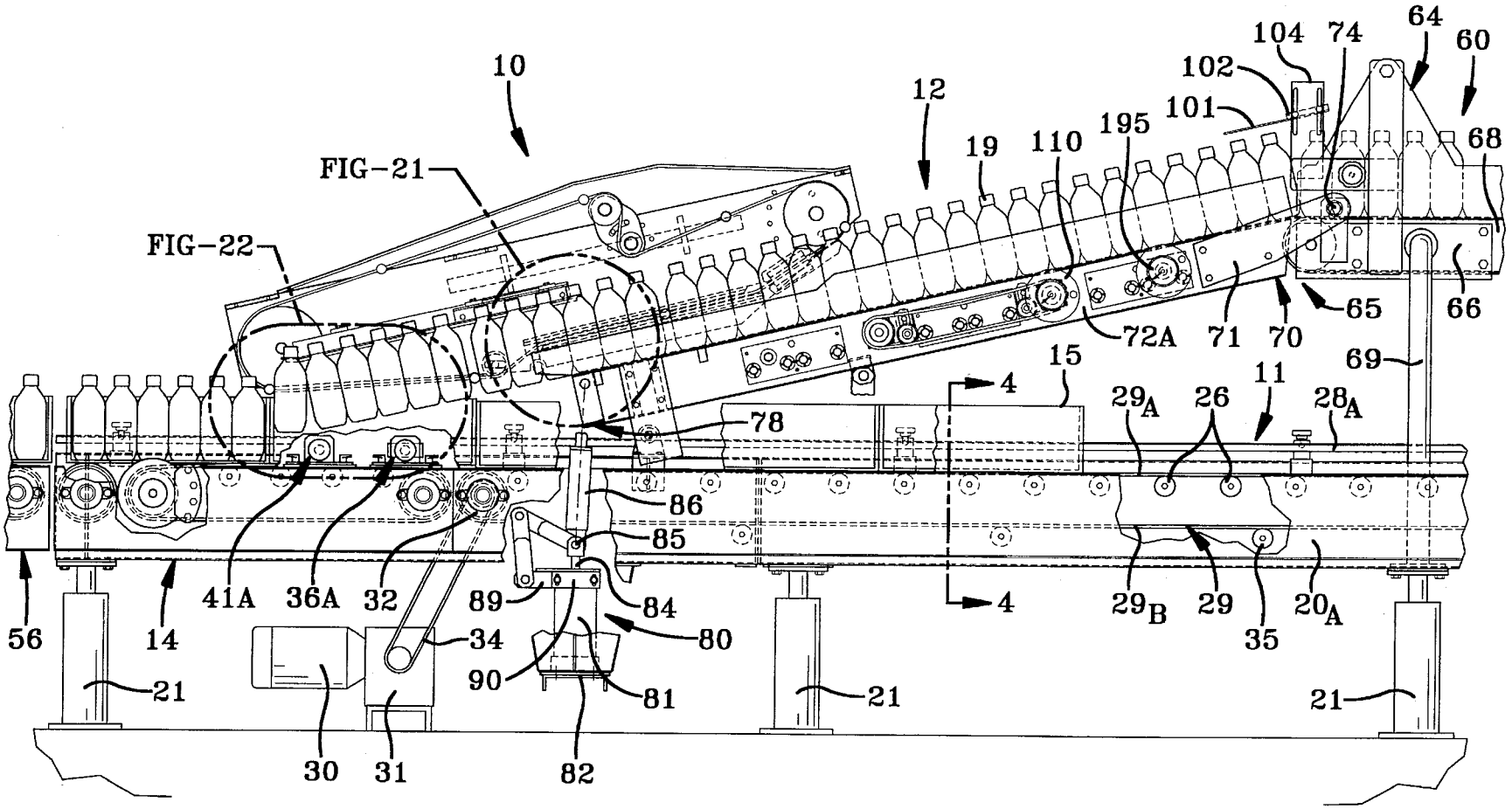
FIG. 2 is a view similar to FIG. 1 but partially broken away and with some otherwise hidden lines depicted in phantom.
Figure 4:
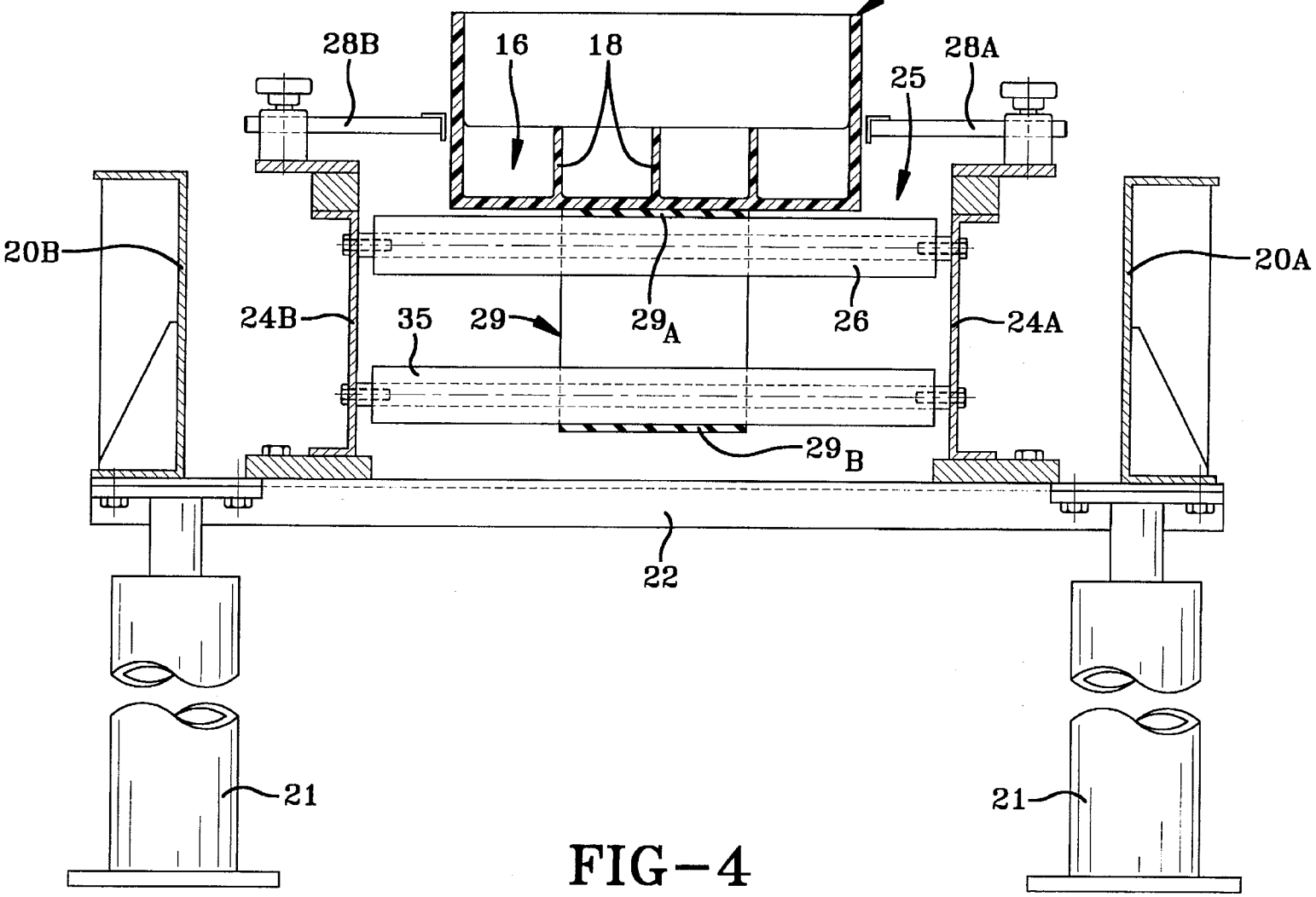
FIG. 4 is an enlarged cross section taken substantially along line 4—4 of FIG. 2.

With particular reference to FIGS. 1 and 2 it will be observed that the packing apparatus 10 has a carton delivery queue 11 that extends in vertically spaced relation operatively to intersect an article orienting and delivery queue 12 at a loading station 14. The cartons 15 that are presented to the loading station 14 by the carton delivery queue 11 may include individual pockets 16—as defined by an internal array of dividing web members 18, as best seen in FIG. 4—within which to receive the articles 19 that may, as shown, be filled containers in the nature of bottles, or the like. The carton delivery queue 11 as well as the article orienting and delivery queue 12 may be supported from a common structure in the nature of laterally spaced, longitudinally extending, exterior support beams 20. The support beams 20 may, in turn, be supported from vertically adjustable legs 21 and cross members 22. Laterally spaced, longitudinally extending, side frame members 24 (best seen in FIG. 4) of a canon conveyor 25 are disposed laterally interiorly of the longitudinal support beams 20 to be supported from the cross members 22 and the legs 21. A plurality of laterally extending support rollers 26 are rotatably mounted from the side frame members 24A and 24B. Longitudinally extending, laterally spaced, and adjustable, carton guides 28A and 28B are also mounted on the side frame members 24A and 24B, respectively, of the carton conveyor 25.

A carton feed drive in the nature of a conveyor belt 29 has a drive portion $29_A$ that overlies the upper side of a plurality of relatively closely spaced support rollers 26 to impart the desired propulsion by which the cartons 15 will be driven longitudinally to traverse the carton delivery queue 11 between the lateral carton guides 28A and 28B. As such, the conveyor belt 29 may be powered by a drive motor 30 (FIG. 2) that is operatively connected, as through a gear reducer 31, to a drive roller 32, as by a chain drive 34.

The return portion $29_B$ (FIGS. 2 and 4) of the continuous conveyor belt 29 may be supported by a plurality of idler rollers 35 that are disposed in a plane vertically beneath the support rollers 26. The idler rollers 35 may, as shown, be longitudinally spaced from each other at a greater distance than the longitudinal spacing of the support rollers 26.

As previewed in the previous paragraphs, and as will appear in the detailed description which follows, a particular structural member, component or arrangement may be employed at more than one location. When referring generally to that type of structural member, component or arrangement a common numerical designation shall be employed. However, when one of the structural members, components or arrangements so identified is to be individually identified it shall be referenced by virtue of a letter suffix employed in combination with the numerical designation employed for general identification of that structural member, component or arrangement. Thus, there are two laterally disposed, longitudinally extending, carton guides depicted in FIG. 4 which are generally identified by the numeral 28, but the two specific, individual carton guides are, therefore, identified as 28A and 28B in the specification and on the drawings.

It will also be observed that the continuous conveyor belt 29 has two runs, but the two runs are not identically disposed. In that situation a letter subscript is included in combination with the numerical designation. Thus, whereas the conveyor belt is generally identified by the number 29, the individual runs are, therefore, designated as $29_A$ and $29_B$. It should be further understood that in some situations a member may be replicated in two ways: (1) within a single operating set; or, (2) in replicated operating sets. In this situation a numerical subscript shall be employed to distinguish between the replicated operating sets and a single operating set. These suffix conventions shall be employed throughout the specification in order to enhance clarity, or even to signal the need for close attention so that inadvertent misunderstandings can be avoided.

Figure 5:
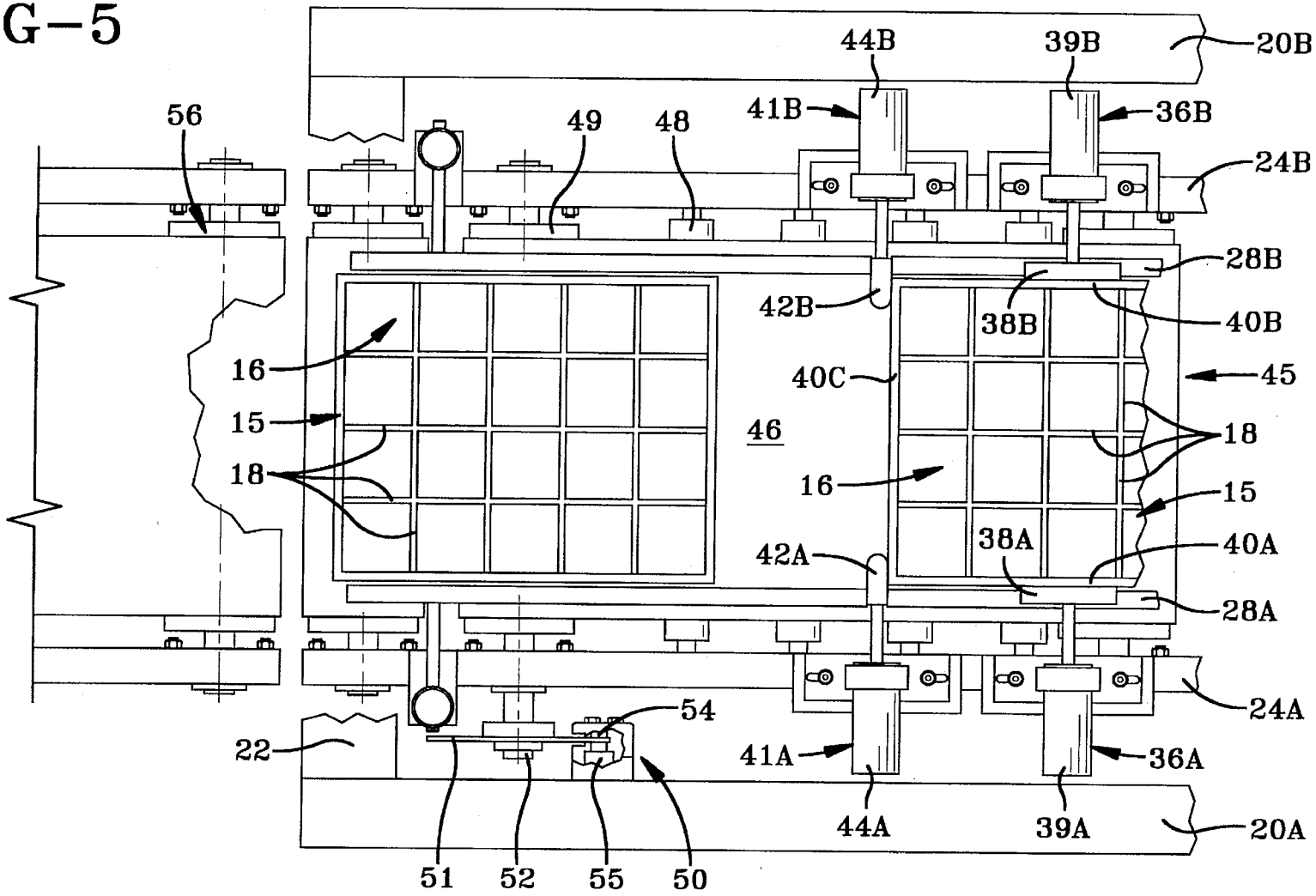
FIG. 5 is an enlarged top plan view of the loading station taken substantially along line 5—5 of FIG. 3.

A carton braking assembly 36 may also be mounted on at least one side frame member 24, or if preferred, a carton braking set 36A may be mounted on frame member 24A and an opposed carton braking set 36B may be mounted on frame member 24B, as best seen in FIG. 5. In either event, the carton braking assembly 36 may include a friction disk 38 that is operatively mounted on a pneumatic cylinder 39 that selectively drives the friction disk 38 into engagement with the adjacent wall 40 of a carton 15 on the carton delivery queue 11 to preclude the forward progress of a carton 15 therealong, including even modest "creep" that might occur during a system shut-down. Creep is generally the result of carton pressure applied upstream of the carton delivery queue 11, and such a result is highly undesirable in the present apparatus 10 wherein movement of the cartons 15 across the loading station 14 is to be achieved solely by the pressure of the articles 19 against the cartons 15. When actuated, the carton braking assembly 36 thus precludes any progress of the cartons 15 onto the loading station 14.

As suggested, only a single carton braking assembly 36 need be employed, and when only one is employed engagement of the friction disk 38A against the adjacent wall 40A forces the opposite wall 40B of that carton 15 into engagement with the opposed carton guide 28B. In the situation where two carton braking assemblies 36A and 36B are employed, as shown, they may apply opposing force against the opposite side walls 40A and 40B of the carton 15 disposed therebetween in order to accomplish the same result.

A carton locator assembly 41 (also best seen in FIG. 5) may also be mounted on at least one side frame member 24, or, if preferred, a carton locator assembly 41A may be mounted on frame member 24A and an opposed cannon locator assembly 41 may be mounted on frame member 24B. In either event, each carton locator assembly 41 utilizes a finger 42 that is selectively protracted, and retracted, as by a pneumatic cylinder 44. When protracted, the finger 42 will engage the end wall 40C that defines the leading edge of the carton 15. The carton locator assembly 41 may be utilized to index a carton 15 onto the loading station 14 during initial start-up or at any time, such as when the articles delivery queue 12 is empty or when an article 19 falls down and the delivery progress has been interrupted, as will be hereinafter more fully described in conjunction with the operational description of the apparatus 10.

The loading station 14 incorporates a retarder assembly 45 (also best seen in FIG. 5). The retarder assembly 45 may utilize a relatively high friction, endless belt 46 that preferably overlies substantially the full width of a succession of support rollers 48 at the loading station 14. The endless belt 46 is not itself powered. In fact, the belt 46 is received over a control roller 49 that is operatively connected to a brake device 50. The brake device 50 may utilize a brake disk 51 that is secured to the axle 52 of the control roller 49, and the brake disk 51 is selectively engaged by a braking caliper 54 that may be operated by a pneumatic control cylinder 55. The brake device 50 serves to restrict the free forward progress of a carton 15 that is transferred onto the retarder assembly 45 from the carton delivery queue 11 against possible movement, or creep, generated by successive cartons 15. However, as will be hereinafter more fully apparent, the brake device 50 is set such that the cartons 15 will be forced across the retarder assembly 45 solely by engagement of the articles 19 with the cartons 15 into which the articles 19 are to be received. As such, the impelling force supplied by the carton conveyor belt 29 incorporated in the carton delivery queue 11, while sufficient to propel a successive series of cartons 15 along the carton delivery queue 11, is not sufficient to drive a carton 15 across the endless belt 46 incorporated in the retarder assembly 45 operatively associated with the loading station 14. This result may be further enhanced by employing an engaging surface having a relatively high coefficient of friction on the endless belt. The engaging surface of the belt 46 is elevated above the level of the drive portion $\mathbf{29}_A$ on the conveyor belt 29 which impart the desired propulsion by which the cartons 15 are driven longitudinally along the carton delivery queue 11 to a sufficient degree that a carton received on the engaging surface of the belt 46 will not engage the belt 29. Conversely, the degree to which the belt 46 is elevated above the level of the drive portion $\mathbf{29}_A$ on the conveyor belt 29 is such that the transfer of a carton from the belt 29 to the belt 46 will not impede the free transfer of a carton 15 on the belt 29 in the carton delivery queue 11 to the engaging surface of belt 29. This difference is depicted by the relative height of the carton 15A relative to the height of the carton 15B depicted in FIG. 22.

A discharge conveyor 56 (FIG. 2) facilitates removal of the loaded cartons 15 from the loading station 14. The discharge conveyor 56 may well be provided with a means by which to drive the loaded cartons 15 therealong, but the mechanism by which to operate a discharge conveyor 56 is so well known that it is not deemed necessary to include such details in the present disclosure.

The article orienting and delivery queue 12 incorporated in a packing apparatus 10 embodying the concepts of the present invention is located downstream of a well known article supply conveyor 60. In order to assure that the articles 19 being fed to the upstream end 61 of the article orienting and delivery queue 12 will pass properly between the plurality of dividers 62 (FIG. 6) that extend longitudinally along the article orienting and delivery queue 12 to delineate the number of laterally disposed, side-by-side articles 19 that are eventually to be loaded into the cartons 15, a well known article oscillator may be provided at some point along the article supply conveyor 60.

The discharge end 65 of the article supply conveyor 60 may, as shown, be supported in spaced relation upwardly of the carton delivery queue 11. Specifically, a mounting plate 66 may be secured not only to the support beams 68 for the article supply conveyor 60 but also to columns 69 that extend upwardly from the support beams 20 that carry the carton delivery queue 11. As shown, the columns 69 may be disposed in vertical alignment with one set of legs 21 to minimize eccentricity of the loading applied to the legs 21.

In addition, the upstream end 61 of the article orienting and delivery queue 12 is preferably supported from the discharge end 65 of the article supply conveyor 60. The upstream end 61 of the article orienting and delivery queue 12 is delineated by the article-receiving end of a slide assembly 70. As such, the article-receiving end of the slide assembly 70 is also designated by the numeral 61. One end of each of a pair of connecting plates 71 is affixed to the side frame plates 72A and 72B of the slide assembly 70, and the other end of each of the pair of connecting plates 71 is pivotally mounted, as by pin 74, to the frame 75 of the article supply conveyor 60.

Although one could conceivably utilize a fixed connection between the slide assembly 70 and the article supply conveyor 60, the pin connection 74 provides several improvements to the operation of the apparatus 10. One of the primary benefits is that the slide assembly 70 can be disposed at a selected inclination in order to achieve the most favorable results when the articles 19 slide, by gravity, down the hereinafter described, inclined ramp surface 76 (FIGS. 12 and 13) on the slide assembly 70. It should be understood that the line pressure applied by the article supply conveyor 60 to the articles 19 being delivered thereby will, to some degree, be applied against the articles 19 on the slide assembly 70, but as will be hereinafter more fully explained, gravity propulsion of the articles 19 as they move down the side assembly 70 is a significant factor in the operation of the packer apparatus 10.

Because of the function to be performed by the ramp surfaces 76, those surfaces should possess a relatively low coefficient of friction. This result can be achieved by applying coatings, or tape, to the surfaces 76. One must, however, be careful to use a material having a coefficient of friction that is not adversely affected by moisture, particularly in the bottling industry. In addition, the pivotal connection 74 of the slide assembly 70 permits the operator to select the clearance spacing between the downstream end 78 of the slide assembly 70 and the cartons 15 being delivered to the loading station 14 from the carton delivery queue 11. Finally, the use of a pivotal connection 74 allows the slide assembly 70 to be raised for access therebeneath in the event that the cartons 15, or even the articles 19, jam beneath the slide assembly 70.

Figure 3:
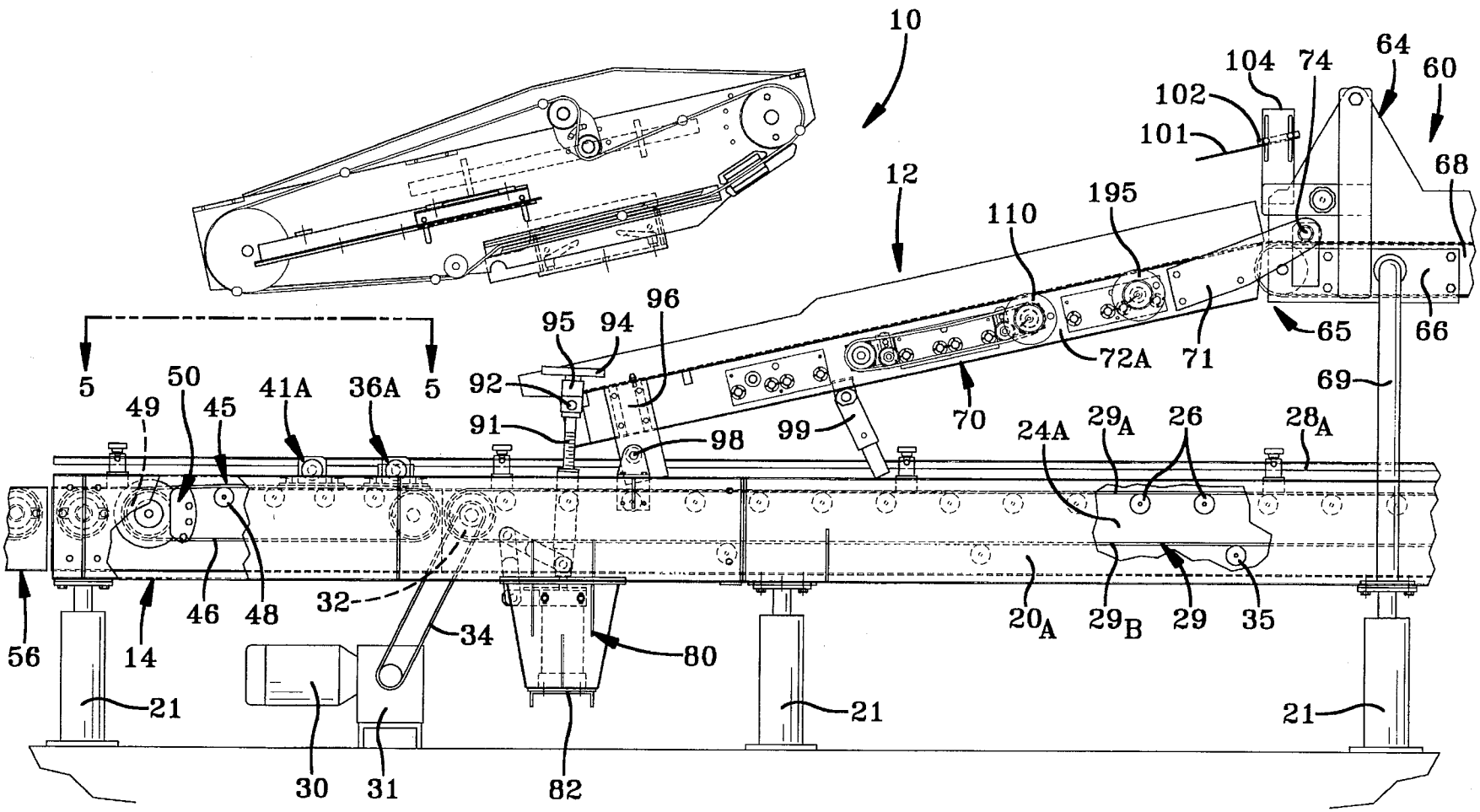
FIG. 3 is a view similar to FIG. 2 but with the articles and cartons removed to emphasize the demountable loading head assembly, which is depicted in a displaced vertical position.

The aforesaid swinging movements of the slide assembly 70 about the pivot pin 74 may be readily achieved by a lift mechanism 80 (FIGS. 1 through 3) that is capable of selectively providing relatively rapid movement, in gross—or, alternatively, incremental micro-adjustment—of the downstream end 78 of the slide assembly 70. Specifically, the lift mechanism 80 may utilize a pair of laterally spaced, fast-acting pneumatic cylinders 81 that are disposed on either side of the downstream end 78 of the slide assembly 70 to effect "in gross" adjustment. The cylinders 81 are supported from a yoke 82 that is secured to the support beams 20. A piston rod 84 that is axially reciprocable from each pneumatic cylinder 81 is pivotally connected, as by pivot pin 85, to the base of an internally threaded jack cylinder 86 that receives a threaded jack screw shaft 88 which meshingly engages the threads on the interior of the jack cylinder 86. As such, rotation of the jack screw shaft 88 relative to the jack cylinder 86 effects axial translation of the jack screw shaft 88, which meshingly engages the threads on the interior of the jack cylinder 86 to effect micro-adjustment. A torque knuckle 89 is connected between the rim 90 of each fast-acting cylinder 81 and the pivot pin 85 to assure that rotation of the jack screw shaft 88 will effect only relative rotation between the jack screw shaft 88 and the jack cylinder 86.

A non-threaded portion 91 (FIGS. 1 and 3) of each jack screw shaft 88 passes through a thrust bearing 92 that is secured to each frame plate 72 of the slide assembly 70. The non-threaded portion 91 of the jack screw shaft 88 extends axially beyond the thrust bearing 92 to receive a crank wheel 94 that permits manual, micro-adjustment of the jack screw shaft 88. Hence, rotation of the crank wheel 94 controls the vertical disposition of the downstream end 78 of the slide assembly 70 with respect to the top of the cartons 15 on the carton delivery queue 11.

The jack screw shaft 88 may preferably be connected to a mechanical, or an electronic, read-out 95 which displays the axial disposition of the jack screw shaft 88 with respect to the thrust bearing 92, or any other relatively fixed frame of reference selected.

In order to assure lateral stability to the downstream end 78 of the slide assembly 70, a lateral stabilization plate 96 may be secured to each frame plate 72 of the slide assembly 70, and the stabilization plate 96 may be received between, and engage, lateral locating members 98 that are affixed to, and extend upwardly from, the support beams 20 of the packing apparatus 10. A manually operated safety support arm 99 may be pivotally mounted on the slide assembly, as by pivot pin 100, to the underside of the slide member 70 so that when the downstream end 78 of the slide assembly 70 has been raised to permit operator access therebeneath, the support arm 99 may be swung down to engage the side frame plates 24 of the carton conveyor 25 and thereby assure the safety of anyone working beneath the swingable slide assembly 70.

A retainer plate 101 is supported above the juncture of the slide assembly 70 and the discharge end 65 of the article supply conveyor 60 by a cross beam 102 that extends between laterally aligned arms 104 that are supported from the frame 75 of the article supply conveyor 60. The purpose of the retainer plate 101 is to preclude the articles 19 which are exiting from the discharge end 65 of the article supply conveyor 60 from engaging the articles 19 that have just been transferred onto the slide assembly 70 and thereby forcing the articles 19 most recently transferred onto the slide assembly 70 from being forced upwardly, and off, the slide assembly 70.

The apparatus 10 may be called upon to load a wide variety of bottle sizes. In fact, even bottles having substantially the same volumetric capacity may have at least slightly different vertical and lateral dimensions. To accommodate either situation, the present apparatus 10 includes a facile means 105 (FIG. 6 and related figures) by which to adjust the lateral location of the dividers 62 that extend longitudinally along, and, as will be hereinafter more fully explained, between the plurality of ramp members 200 (FIG. 13) provided on the slide assembly 70 to present the ramp surfaces 76.

Figure 6:
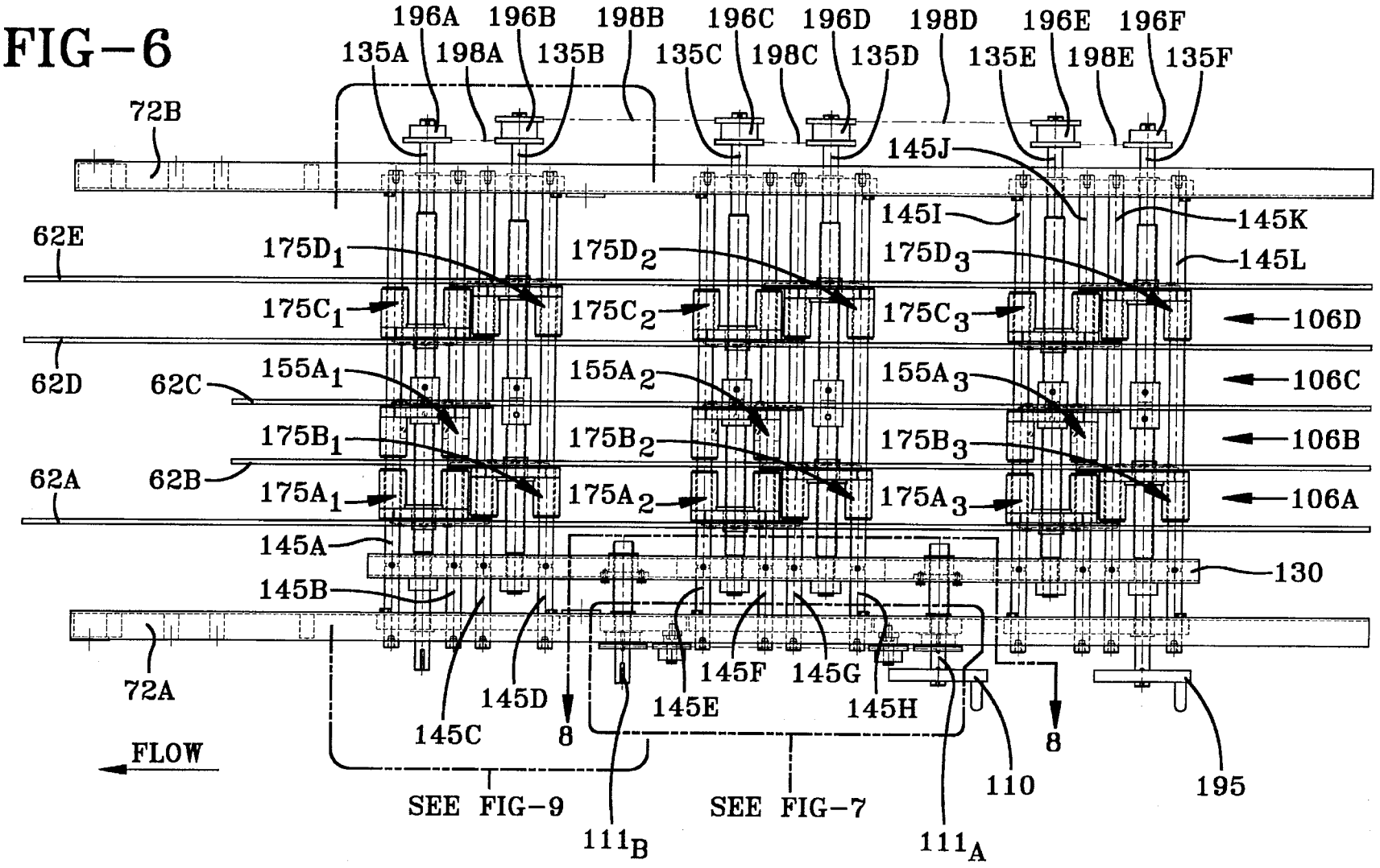
FIG. 6 is a top plan view of the slide assembly, but with the articles and the inclined ramp members removed in order more clearly to reveal the center-line and lane-width adjusting mechanism incorporated in the slide assembly.

As best seen in FIG. 6, there are a plurality of dividers 62. For example, when the apparatus is to load articles 19 in an even number of lateral files 106, there must not only be one more divider 62 than the number of laterally spaced, longitudinally extending, files 106 in which the articles 19 are to be received in the cartons 15, but also one of those dividers 62C must delineate the longitudinal center-line with an even number of files on either side of that center-line divider 62C. In the example depicted there are four files 106A through 106D, and that requires five dividers 62A through 62E. Hence, divider 62C delineates the center-line of the four files 106 of articles 19 that ate to slide down the hereinafter described inclined ramp surface 76 on the slide assembly 70.

Figure 7:
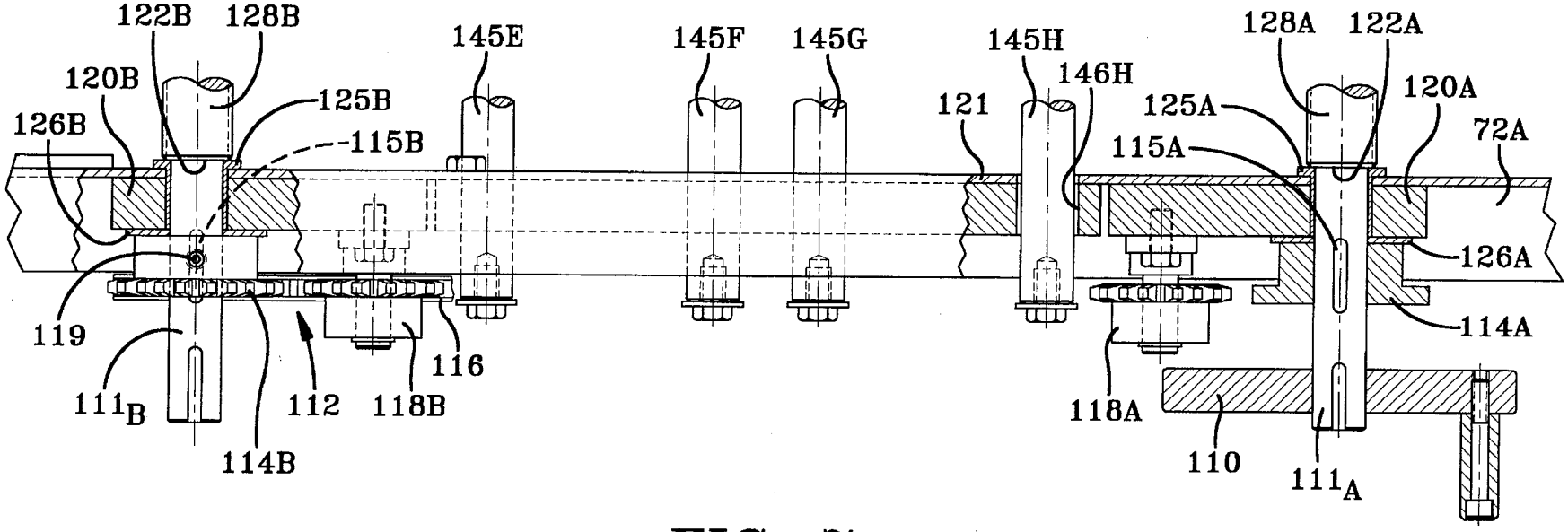
FIG. 7 is that area of FIG. 6 included substantially within the chain-line, generally rectilinear, outline identified as "SEE FIG.-7" which has been enlarged for clarity.

A center-line adjusting handle 110 is connected to a primary center-line, adjusting shaft $\mathbf{111}_A$ and, through a chain drive connection 112, to a slave center-line adjusting shaft $\mathbf{111}_B$, as best shown in FIG. 7. Specifically, a connecting sprocket 114A is secured, as by a key 115A, to rotate with the primary center-line adjusting shaft $\mathbf{111}_A$, and a similar connecting sprocket 114B is secured, as by key 115B, to rotate the slave center-line adjusting shaft $\mathbf{111}_B$ in response to rotation of the center-line adjusting handle 110. A continuous drive chain 116 meshingly engages the connecting sprockets 114A and 114B on the primary and slave center-line adjusting shafts $\mathbf{111}_A$ and $\mathbf{111}_B$ and passes over a plurality of idler sprockets 118 to effect the desired spacing between the respective upper and lower runs $\mathbf{116}_A$ and $\mathbf{116}_B$ of the continuous drive chain 116 in order to effect the desired clearance for members of the hereinafter more fully described center-line adjustment and the inter-connected lane-width adjustment mechanisms. It will be observed that the sprockets 114 are secured against axial movement with respect to the shafts 111 by virtue of set screws 119 which, as shown, may engage the keys 115 in order not to mar the outer surface of the shafts 111.

Figure 9:
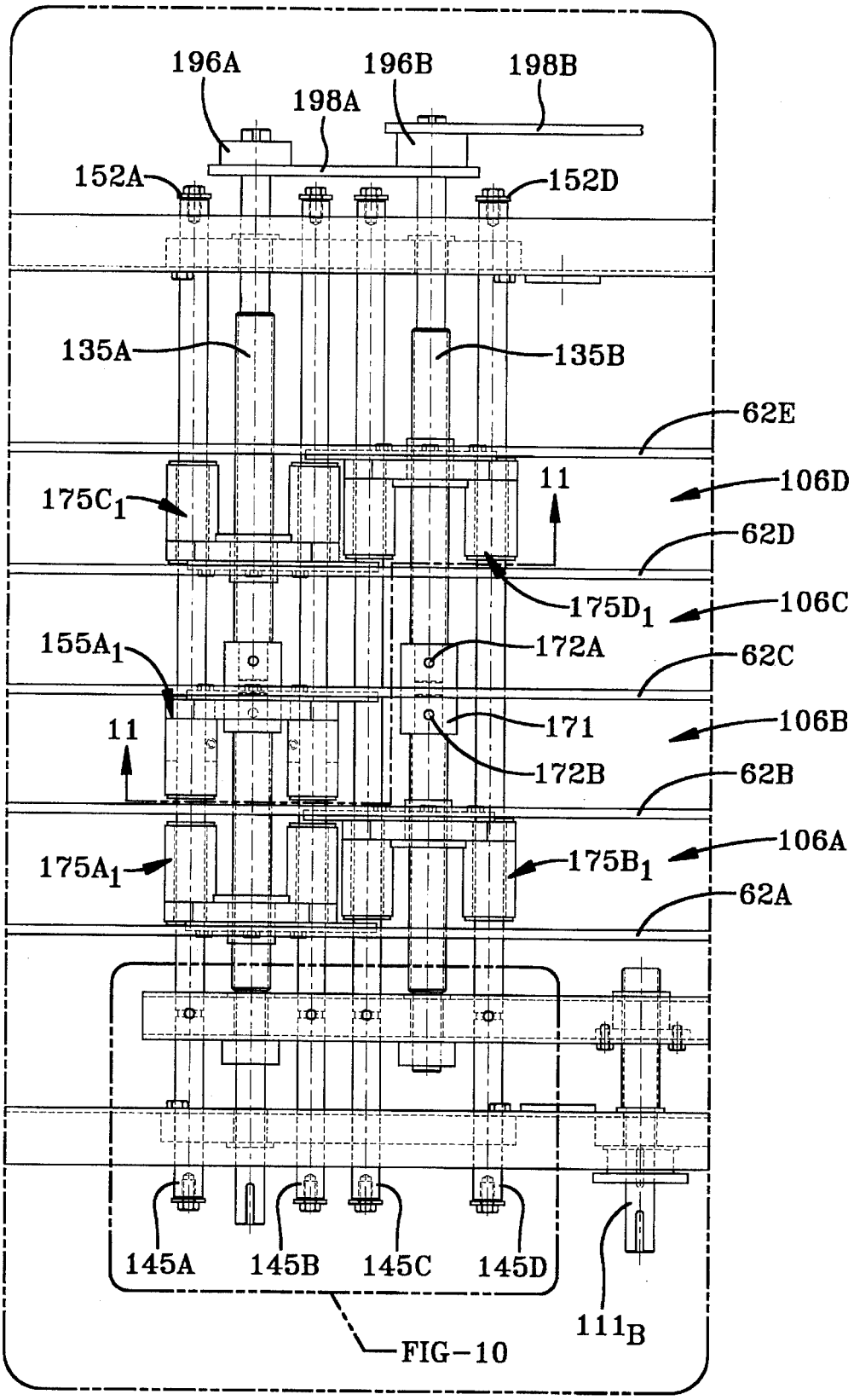
FIG. 9 is that area of FIG. 6 within the chain-line rectangle identified as "SEE FIG.-9" which has been enlarged for clarity.

Returning to the description of the center-line adjusting mechanism (as best seen in FIGS. 6, 7 and 9), the primary center-line adjusting shaft $\mathbf{111}_A$ extends through a reinforcing plate 120A mounted on the web portion 121 of the slide assembly frame plate 72A. Each center-line adjusting shaft 111 is restrained against axial movement in one direction by the shoulders 122A and 122B that engage a respective flanged bearing sleeve 125A and 125B seated against the reinforcing plates 120A and 120B. Each center-line adjusting shaft 111 is restrained against axial movement in the other direction by the respective sprockets 114A and 114B that are, themselves, secured against axial movement relative to the particular shaft 111 on which each is received by engagement of the set screws 119 with the keys 115. Flanged bearing sleeves 125 and annular washers 126 are also employed in order to permit facile rotation of the shafts 111 with respect to the frame plate 72A of the slide assembly 70.

That extent of the primary center-line adjusting shaft $\mathbf{111}_A$ which continues beyond the frame plate 72A constitutes a threaded portion 128A that threadably engages a collar 129A which may be in the form of a flanged nut that is secured to the web portion 131 of a shift member 130 that may be in the configuration of a channel iron, as shown. As shown, the idler sprockets 118 may be rotatably mounted on the reinforcing plates 120.

As should now be apparent, rotation of the center-line adjusting handle 110, and the resulting concomitant rotation of the center-line adjusting shafts 111, effects lateral displacement of the shift member 130.

Figure 8:
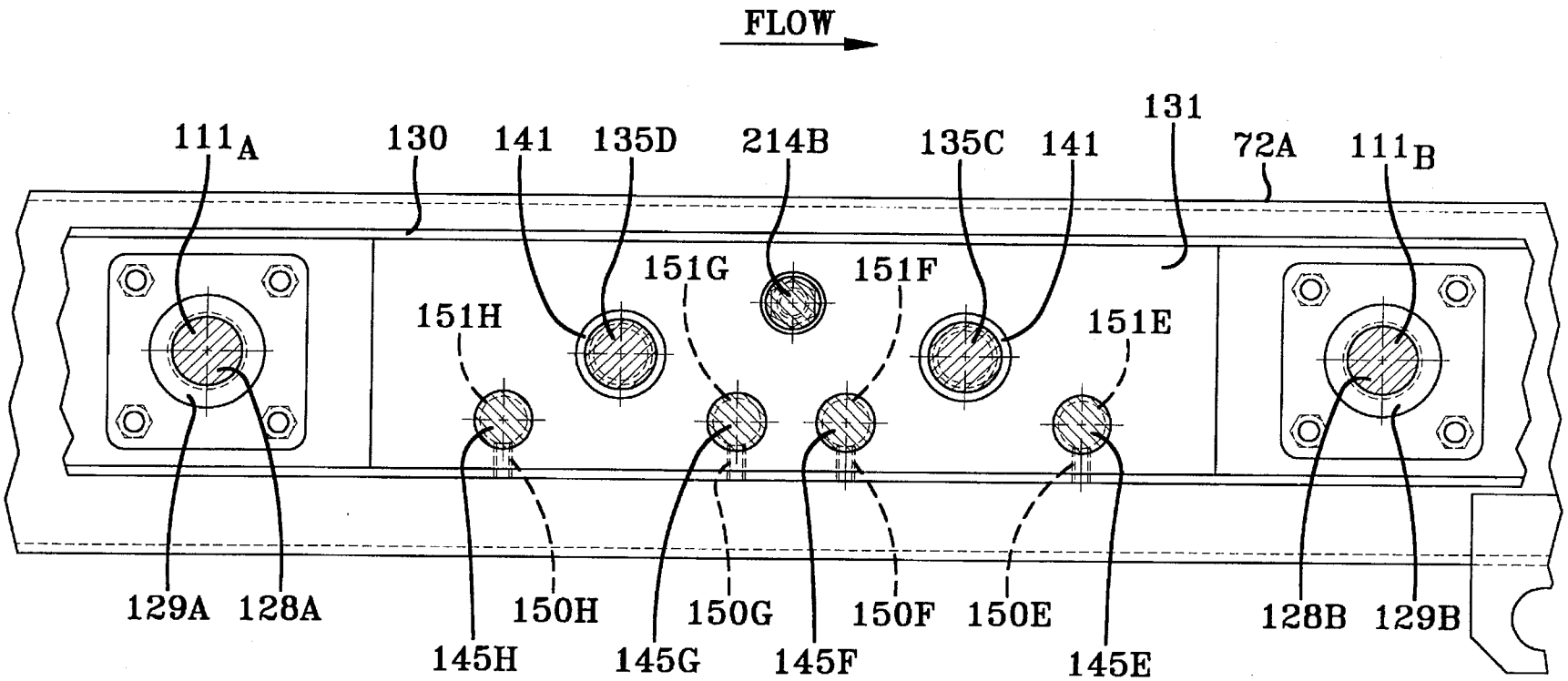
FIG. 8 is an enlarged cross section taken substantially along line 8—8 of FIG. 6.
Figure 10:
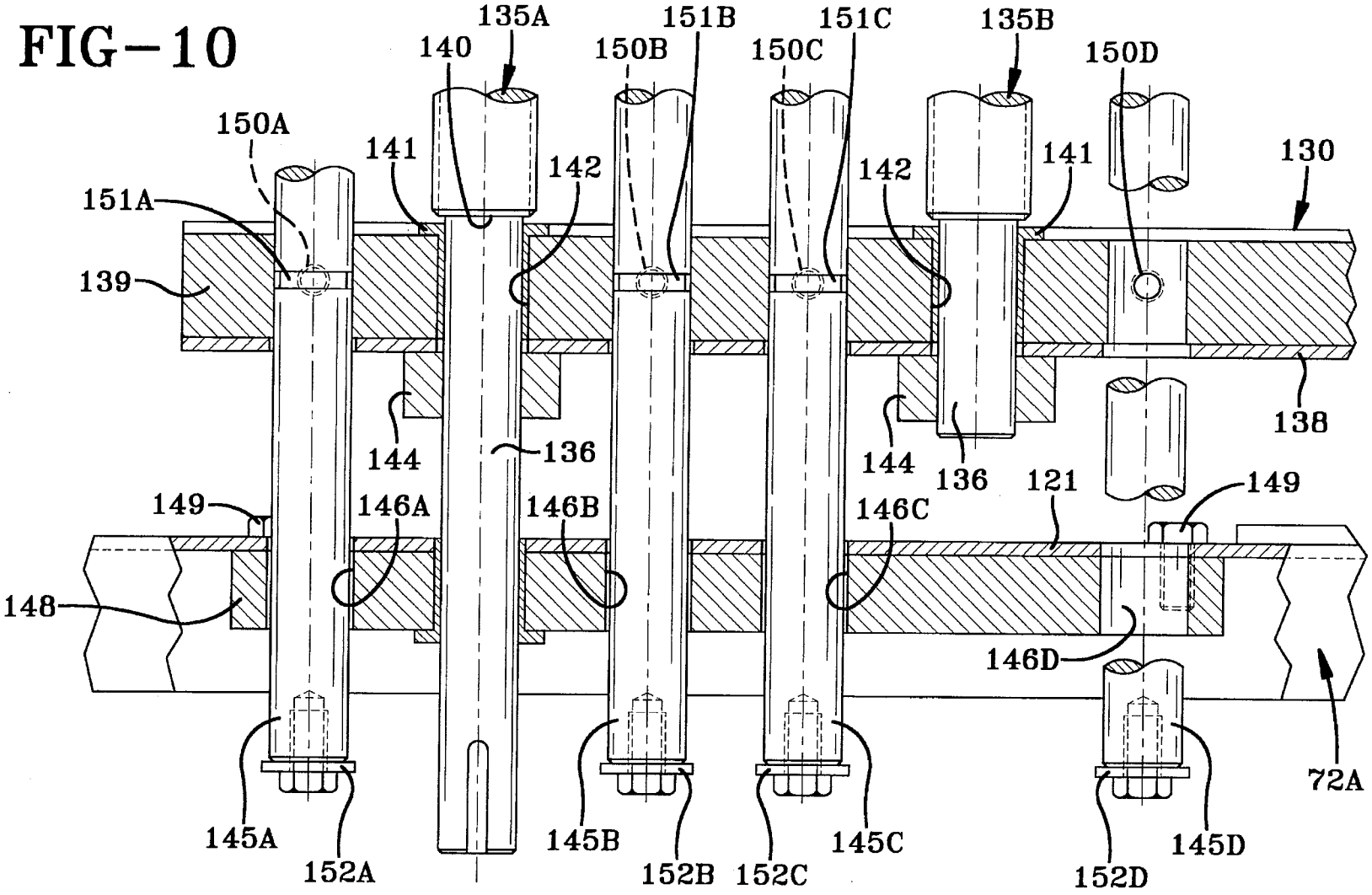
FIG. 10 is that area of FIG. 9 within the chain-line rectangle identified as "SEE FIG.-10" which has been enlarged for clarity.

In order more fully to appreciate how the dividers 62—and first the center-line divider 62C—are moved laterally in response to lateral displacement of the shift member 130 it should be observed from FIGS. 8 through 10 that a plurality of laterally extending adjusting shafts 135 are rotatably mounted on, and extend outwardly from, the shift member 130. As shown, that portion 136 of each adjusting shaft 135 passing through the web portion 138 of the shift member 130—and the reinforcing plate 139 that may be attached to the web portion 138—may be of reduced diameter. That configuration provides a shoulder 140 which engages a flanged sleeve bearing 141 that extends through a bore 142 which penetrates both the reinforcing plate 139 and the web portion 138 of the shift member 130. A retaining collar, or other member, 144 may be staked, or otherwise affixed, to the portion 136 of reduced diameter so that the opposed shoulder 140 and retaining collar 144 embrace the reinforcing plate 139 and the web portion 138 of the channel-shaped shift member 130 therebetween, and in such a manner that the adjusting shafts 135 are freely rotatable with respect to the shift member 130, but yet the adjusting shafts 135 are precluded from relative axial displacement with respect to the shift member 130. To the contrary, each adjusting shaft 135 is axially translatable through the frame plates 72 and the associated reinforcing plates 148. This condition may be assured by interposing a linear bearing sleeve 143 between each adjusting shaft 135 and the combined frame and reinforcing plates 72 and 148, respectively. In the embodiment depicted, there are six adjusting shafts $\mathbf{135}_A$ through $\mathbf{135}_F$.

A plurality of guide rods 145 are also affixed to the shift member 130, as by individual set screws 150 that extend through the reinforcing plate 139 to engage an annular recess 151 in each guide rod 145. The use of an annular recess 151 was selected simply to facilitate receipt of the set screw 150 therein. The guide rods 145 need not be rotatable. In the embodiment depicted there are twelve guide rods $\mathbf{145}_A$ through $\mathbf{145}_L$. While the guide rods 145 are affixed to the shift member 130, each guide rod 145 is permitted to be axially translated through appropriate apertures 146 which penetrate both a reinforcing plate 148 in each frame plate 72 as well as the web portion 121 of each laterally spaced frame plates 72A and 72B in the slide assembly 70. As best depicted in FIG. 10, the reinforcing plate 148 may be secured to the web portion 121 by machine bolts 149. At this plaint it should be explained that the length of the guide rods 145 should be sufficient that they will not disengage from the apertures 146 as the shift member 130 is translated laterally. If desired, therefore, one may employ removable stops 152 on each end of each guide rod 145.

The function of the adjusting shafts 135 and the guide rods 145 can best be appreciated by focusing first on the mechanism by which center-line adjustment is achieved and sequentially thereafter on the inter-related mechanism by which lane-width adjustment is achieved.

Figure 11:
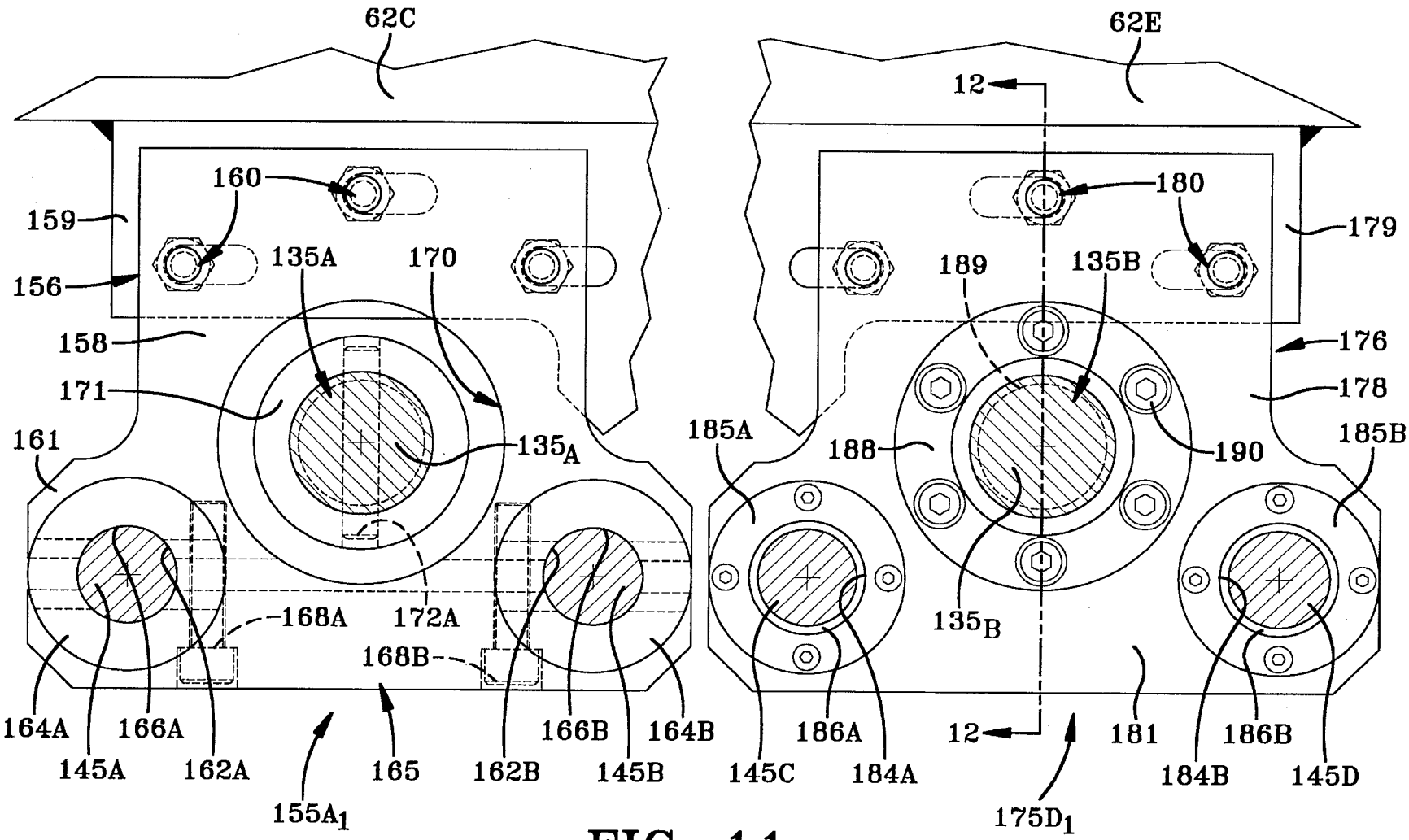
FIG. 11 is an enlarged cross section taken substantially along line 11—11 of FIG. 9.

With respect to the center-line adjusting mechanism, the central divider 62C is mounted on one or more center-line carriages 155 that are fixedly secured to appropriate guide rods 145. In the preferred embodiment depicted, there are three center-line carriages $\mathbf{155}A_1$ through $\mathbf{155}A_3$ that support the central divider 62C. With particular reference to FIG. 11 it will be observed that the carriage $\mathbf{155}A_1$ includes a base plate 156 that has a generally inverted, T-shaped configuration. The stem portion 158 of the base plate 156 may be selectively secured to a mounting fin 159 by a plurality of machine screws 160. The mounting fin 159 may, as shown, be secured, as by welding, to the underside of the divider plate 62C. The cross head portion 161 of the T-shaped base plate 156 has a pair of truncated, semi-cylindrical recesses 162A and 162B that are provided in laterally extended housings 164A and 164B, respectively, which are attached to, and extend outwardly from, the cross head 161 of the base plate 156. The truncated, semi-cylindrical recesses 162A and 162B are adapted to engage the guide rods 145A and 145B, respectively.

A clamping plate 165 is provided with similarly truncated, semi-cylindrical recesses 166A and 166B that are disposed in opposition to the respective recesses 162A and 162B in the cross head portion 161 of the base plate 156. A pair of countersunk machine screws 168A and 168B may be employed to secure the clamping plate 165 to the cross head portion 161 of the base plate 156. Hence, by tightening the machine bolts 168 the center-line carriage $\mathbf{155}A_1$ is secured to the guide rods 145A and 145B such that the center-line carriage $\mathbf{155}A_1$ can not move with respect to the guide rods 145A and 145B.

Center-line adjusting carriage $\mathbf{155}A_2$ may be similarly secured to guide rods 145E and 145F, and centerline carriage $\mathbf{155}A_3$ may be similarly secured to guide rods 145I and 145J, as depicted in FIG. 6.

With continued reference to FIG. 11, an aperture 170 may be located in proximity to the juncture of the stem portion 158 with the cross head portion 161 of the base plate 156 to allow the center-line carriage $\mathbf{155}A_1$ to move laterally along the adjustment shaft 135A, but without making any engagement therewith. At this point it can be observed that the adjusting shafts 135 can comprise a pair of linearly aligned shaft sections $\mathbf{135}_A$ and $\mathbf{135}_B$ that may be conjoined into the single shaft 135 by a coupling sleeve 171 and fastening means 172A and 172B in the nature of set screws, or pins, as shown. It is, of course, quite possible to have each adjusting shaft 135 be a single unitary member, but because the opposite ends of each adjusting shaft will be threaded at opposite hand, and at different pitches, it may be cost effective to conjoin the two individual shaft sections $\mathbf{135}_A$ and $\mathbf{135}_b$ into a single adjusting shaft 135. As such, the aperture 170 in the center-line adjusting carriages 155A should constitute an opening of sufficient dimension to obviate interference between the adjusting shafts 135A, 135C and 135E (including any coupling sleeves 171) and the center-line carriages $\mathbf{155}A_1$ through $\mathbf{155}A_3$.

Because the center-line carriages 155A are secured to the shift member 130 through the guide rods 145A, 145B, 145E, 145F, 145I and 145J, rotation of the adjusting shafts 111 by the adjusting handle 110 effects lateral translation of the central divider 62C. Hence, the center-line adjusting handle 110 can be rotated to effect precise location of the center-line divider 62C.

Before detailing the structural configuration of the lane-width adjusting mechanism, it should be understood that the concept of the present invention requires two adjusting shafts 135 in order to effect a lane-width adjustment for the four files 106A through 106D depicted. However, in the preferred embodiment described herein, three sets of four lane-width adjusting carriages 175A, 175B, 175C and 175D are utilized. The replication of the lane-width adjusting carriages 175, as well as the center-line adjusting carriages 155, is utilized not only to preclude binding of the dividers during adjustment, but also to assure that the dividers 62 will not laterally vibrate in an unacceptable manner during operation of the packing apparatus 10. This result can be accomplished by employing multiple connections of the lateral adjusting means with each of the dividers 62. Such replication may be readily accomplished by utilizing a plurality of adjusting shafts 135 in a unique arrangement whereby they may all be simultaneously operated by a single lane-width adjusting handle 190, as will be hereinafter more fully explained.

With reference to FIG. 6 it can be observed that lane-width adjusting carriages $\mathbf{175}A_1$, $\mathbf{175}A_2$ and $\mathbf{175}A_3$ operatively engage divider 62A and are respectively associated with adjusting shafts 135A, 135C and 135E. Similarly, lane-width adjusting carriages $\mathbf{175}B_1$, $\mathbf{175}B_2$ and $\mathbf{175}B_3$ operatively engage divider 62B and are respectively associated with adjusting shafts 135B, 135D and 135F. Likewise, lane-width adjusting carriages $\mathbf{175}C_1$, $\mathbf{175}C_2$ and $\mathbf{175}C_3$ operatively engage divider 62D and are respectively associated with adjusting shafts 135A, 135C and 135E. Finally, lane-width adjusting carriages $\mathbf{175}D_1$, $\mathbf{175}D_2$ and $\mathbf{175}D_3$ operatively engage divider 62E and are respectively associated with adjusting shafts 135B, 135D and 135F. As best seen in FIG. 11, divider 62E is mounted on lane-width adjusting carriages 175D$_1$ that is slidably supported on guide rods 145C and 145D.

Figure 12:
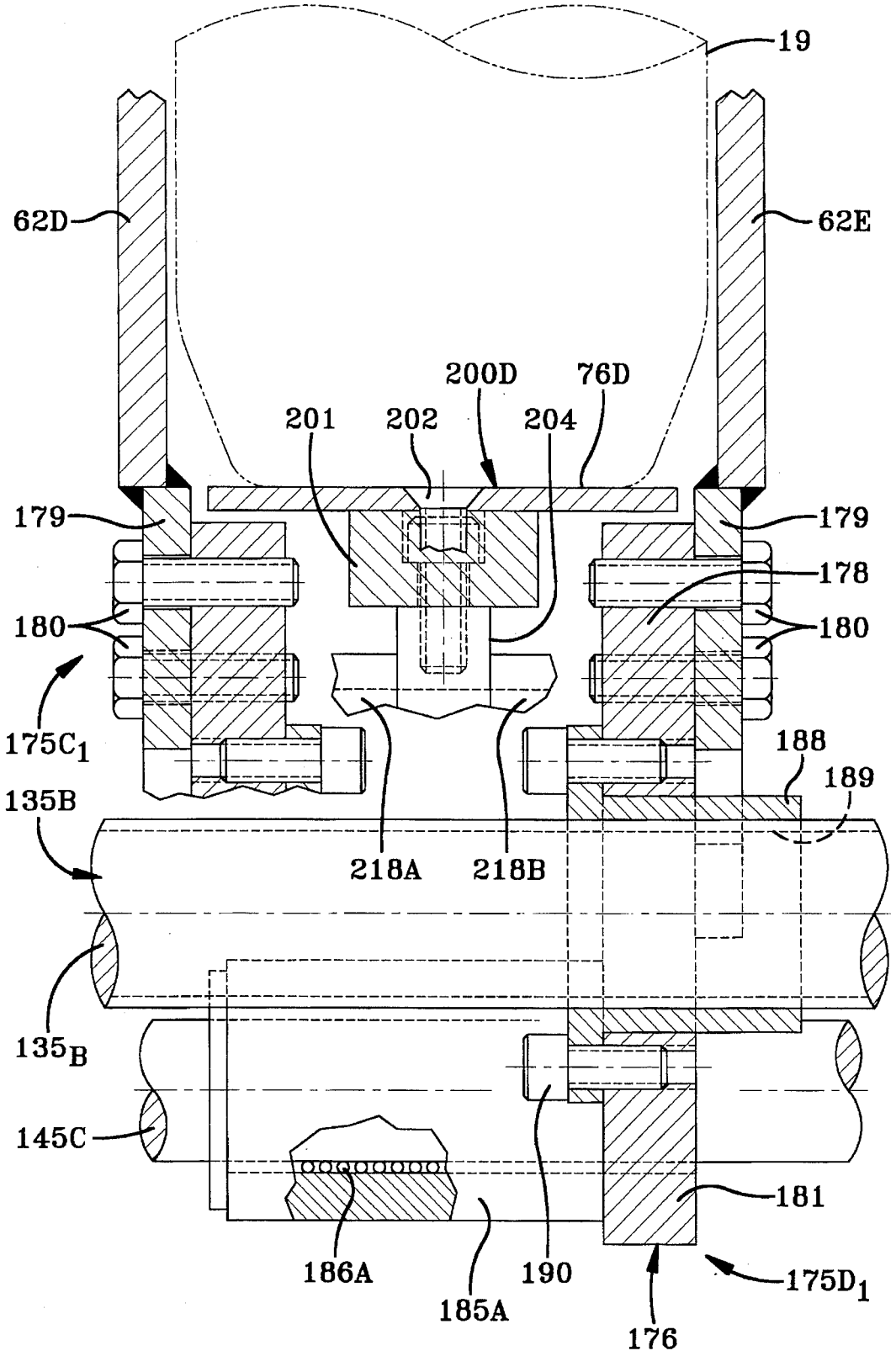
FIG. 12 is an enlarged cross section taken substantially along line 12—12 of FIG. 11.

In the preferred embodiment depicted, lane-width adjusting carriage 175D$_1$ (as best depicted in FIGS. 11 and 12) includes a base plate 176 that has a generally inverted, T-shaped configuration. The stem portion 178 of the base plate 176 may be selectively, and preferably adjustably, secured to a mounting fin 179 by a plurality of machine screws 180. The mounting fin 179 may, as shown, be secured, as by welding, to the underside of the divider plate 62E. The cross head portion 181 of the T-shaped base plate 176 has a pair of cylindrical apertures 184A and 184B that extend axially through laterally extended housings 185A and 185, respectively, that are attached to, and extend outwardly from, the cross head portion 181 of the base plate 176. A linear bearing sleeve 186A and 186B is received within the respective apertures 184A and 184B to be interposed between the radially inner surface of each aperture 184 and the exterior surface of the guide rod 145 that extends through that aperture. In that way the lane-width adjusting carriage 175D$_1$ will readily traverse the stabilizing rods 145C and 145D.

Lane-width adjusting carriage 175D$_2$ may be similarly connected to stabilizing rods 145G and 145H, and lane-width adjusting carriage 175D$_3$ may be similarly connected to stabilizing rods 145K and 145L, as depicted in FIG. 6.

With continued reference to lane-width adjusting carriage 175D$_1$ depicted in FIGS. 11 and 12, a preferably removable collar 188 having a threaded aperture 189 may be secured, as by machine screws 190, to the base plate 176 in proximity to the juncture of the stem portion 178 and the cross head portion 181 in order to allow the lane-width adjusting carriage 175D$_1$ to move laterally along the stabilizing rods 145C and 145D, but only in response to rotation of adjusting shaft 135B. At this point it can be reiterated that each adjusting shaft—such as adjusting shaft 135B can, as shown, comprise a pair of linearly aligned shaft sections 135$_A$ and 135$_B$ which may be conjoined by a coupling sleeve 171 and set screws 172A and 172B, as shown in FIG. 9, but that it is quite possible to have each adjusting shaft be a single unitary member. In either event, the portion 135$_A$ is of opposite hand than portion 135$_B$ and moreover, the pitch of the threads on portions 135$_A$ is an even multiple, or an even fractional multiple, of the thread pitch on portion 135$_B$. In the present situation the pitch will, as will be hereinafter explained, be either an even multiple of two or a fractional multiple of one-half.

Before explaining the reason for the opposite hand of the threads, and the relative pitch thereof, it should be observed that when the lane-adjusting handle 195 is turned in either direction to effect the desired rotation of the adjusting shaft 135F on which the handle 195 may be operatively mounted, all of the adjusting shafts 135 will rotate in exactly the same direction and at exactly the same rotational speed. This result is obtained because sprockets 196 of identical radial dimension, and with an identical number of teeth, are mounted on one end of each adjusting shaft 135. Sprocket 196A and sprocket 196F are both single-bladed sprockets, and sprockets 196B through 196E are both double-bladed sprockets. The sprockets 196 on successively adjacent adjusting shafts 135 are operatively connected by a succession of drive chains 198A through 198E such that rotation imparted to adjusting shaft 135F by the lane-width adjusting handle 195 will effect concomitant rotational direction, as well as speed, to each of the other adjusting shafts 135A through 135E that remain operatively connected to the adjusting shaft being rotated.

Because the location of the divider 62C is determined by rotation of the center-line adjusting handle 110, and because subsequent adjustment of the dividers located laterally of the center-line divider 62C is achieved relative to the preferably independently adjusted center-line divider 62C, simultaneous adjustment of all dividers 62 located laterally of the center-line divider 62C can be simultaneously effected.

The novel arrangement by which to achieve simultaneous lane-width adjustment utilizes adjusting shaft 135A to effect placement of dividers 62A and 62D and utilizes adjusting shaft 135B to effect placement of dividers 62B and 62E. Moreover, the adjustment of dividers (62A, 62B, 62D and 62E are all simultaneously accomplished relative to the center-line divider 62C. In order to achieve the desired simultaneous adjustment by turning only the lane-width adjusting handle 195 it must be appreciated that movement of the dividers 62B and 62D that are "laterally adjacent" (or "laterally inboard") with respect to the center-line divider 62C—the dividers 62B and 62D are laterally adjacent, or laterally inboard, in that each is separated front the center-line divider 62C by only one file: viz., only files 106B and 106C separate dividers 62B and 62D from divider 62C. Laterally adjacent dividers require only one-half the lateral displacement relative to the dividers that are "laterally outboard" of the center-line divider 62C. Laterally outboard dividers—the dividers 62A and 62E are laterally outboard in that each is separated from the center-line divider 62C by two files: viz., both files 106A and 106B separate divider 62A from center-line divider 62C, and both files 106C and 106D separate divider 62E from divider 62C. Laterally outboard dividers require twice the lateral displacement as the dividers that are laterally adjacent, or laterally inboard, with respect to the center-line divider 62C.

As can be observed by reference to FIG. 9, the desired displacement of the dividers 62B and 62D (that are laterally adjacent the center-line divider 62C) relative to the dividers 62A and 62E (that are laterally outboard of the center-line divider 62C) can be achieved by mounting one laterally outboard divider 62A on the same shaft 135A as one laterally inboard divider 62D. In that situation the adjusting carriage 175A$_1$ on which the laterally outboard divider 62A is mounted operatively engages the threads on portion 135$_A$ of shaft 135A. At the same time the adjusting carriage 175C$_1$ on which the laterally adjacent divider 62D is mounted operatively engages the threads on portion 135$_B$ of shaft 135A. Because the dividers 62A and 62D move in opposite directions the threads on portion 135,, must be of opposite hand with respect to the threads on portion 135$_B$.

To achieve the required relative displacement, however, the threads on portion 135$_A$ require twice the pitch as the threads on portion 135$_B$ of the adjusting shaft 135A. For example, portion 135$_A$ may have five threads per inch, and portion 135$_B$ may have ten threads per inch.

The foregoing situation is simply reversed as to adjusting shaft 135B which controls the lateral displacement to be achieved by laterally adjacent divider 62B and laterally outboard divider 62E through adjusting carriages 175B$_1$ and 175D$_1$, respectively. As such, the threads on portion 135$_A$ of adjusting shaft 135B—which are engaged by lane-width adjusting carriage 175B$_1$—require only one-half the pitch of the threads on portion 135$_B$—which are engaged by lane-width adjusting carriage 175D$_1$—in order to achieve the desired simultaneous translation of the laterally adjacent and the laterally outboard dividers 62B and 62E, respectively. That is, portion $135_A$ of adjusting shaft 135B would require ten threads per inch, and portion $135_B$ of adjusting shaft 135B would require five threads per inch.

To summarize, the thread pitch on the adjusting shafts used to translate any laterally outboard divider is equal to the thread pitch on the adjusting shaft used to translate the divider laterally adjacent to the center-line, or reference, divider multiplied by the number of files between the center-line, or reference, divider and the outboard divider.

The same relationship as to the hand of the threads and the relative pitch thereof would apply to each of the three replications of the lane-width adjusting mechanism depicted in FIG. 6. It should also be appreciated that the sprockets 196 and the drive chains 198 by which the sprockets are inter-connected assure that all adjusting shafts 135 rotate in the same direction and at the same speed. Hence, the three replications of the lane-width adjusting mechanism depicted in the drawings operate simultaneously.

The description has heretofore been directed to an arrangement for delivering articles 19 to the crouton 15 in an even number of files 106. In that situation there is a center-line divider 62C which is co-located with the center-line of the slide assembly 70, and the lane-width to accommodate each file 106 of articles 19 is adjusted relative to the center-line divider 62C. It should also be appreciated that the present invention is equally capable of operating to deliver articles 19 in an odd number of files 106. In that situation divider 62C may be used as a reference divider, rather than a center-line divider. That is, the reference divider 62 is moved to a position laterally of the slide assembly center-line, and the lane-width correction is made such that one file aligns with the center-line of the slide assembly rather than having one divider align with the center-line of the slide assembly 70. When that is done the most remote divider—divider 62E when the reference divider 62C is displaced away from frame plate 72A—may simply be removed. Removal is facilitated by demountably securing the dividers 62 to the lane-width adjusting carriages 175 by a plurality of machine screws 180.

Figure 13:
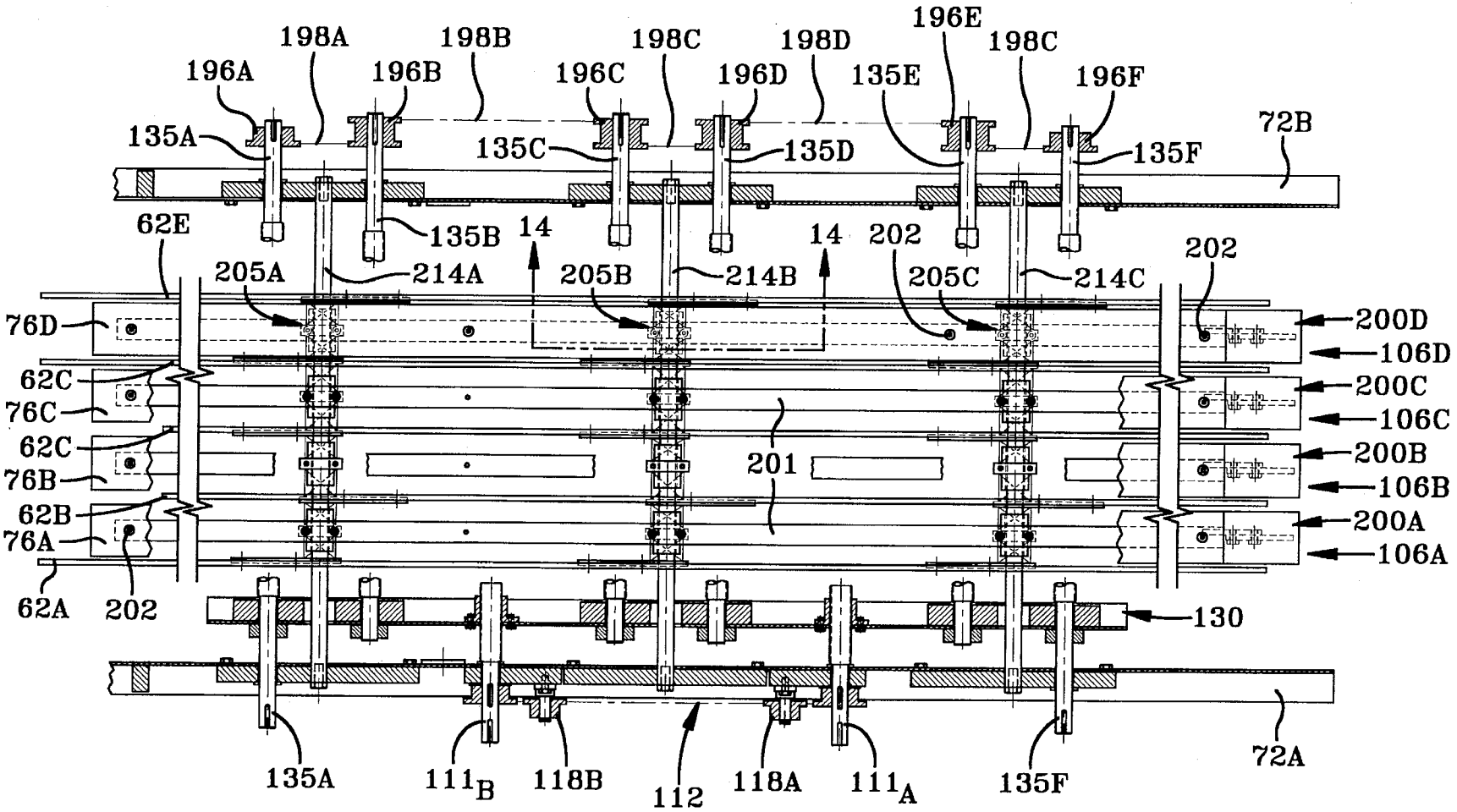
FIG. 13 is a view similar to FIG. 6 but with those portions of the slide assembly germane to the placement of the ramp surfaces relative to the dividers being the focus of the drawing.
Figure 14:
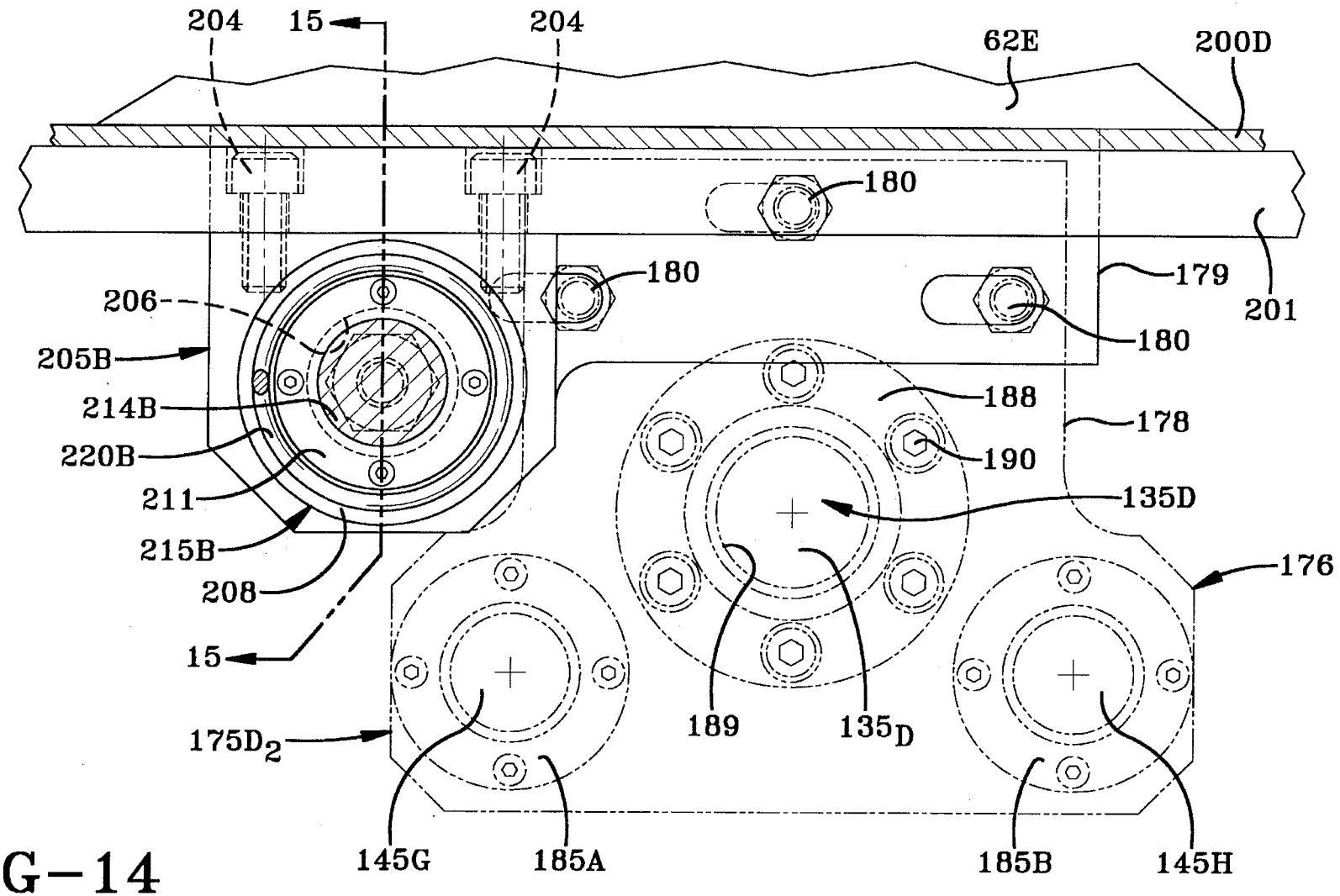
FIG. 14 is an enlarged longitudinal section taken substantially along line 14—14 of FIG. 13 to depict the support-positioning bracket by which the ramp surfaces are automatically located between the successive dividers in the slide assembly, one of the movable carriages for adjusting the location of a lane divider being shown in phantom line for environmental reference—line 14—14 on FIG. 15 provides a cross-reference by which one can relate the substantial location of the longitudinal section depicted in FIG. 14 with respect to the transverse section depicted in FIG. 15.
Figure 15:
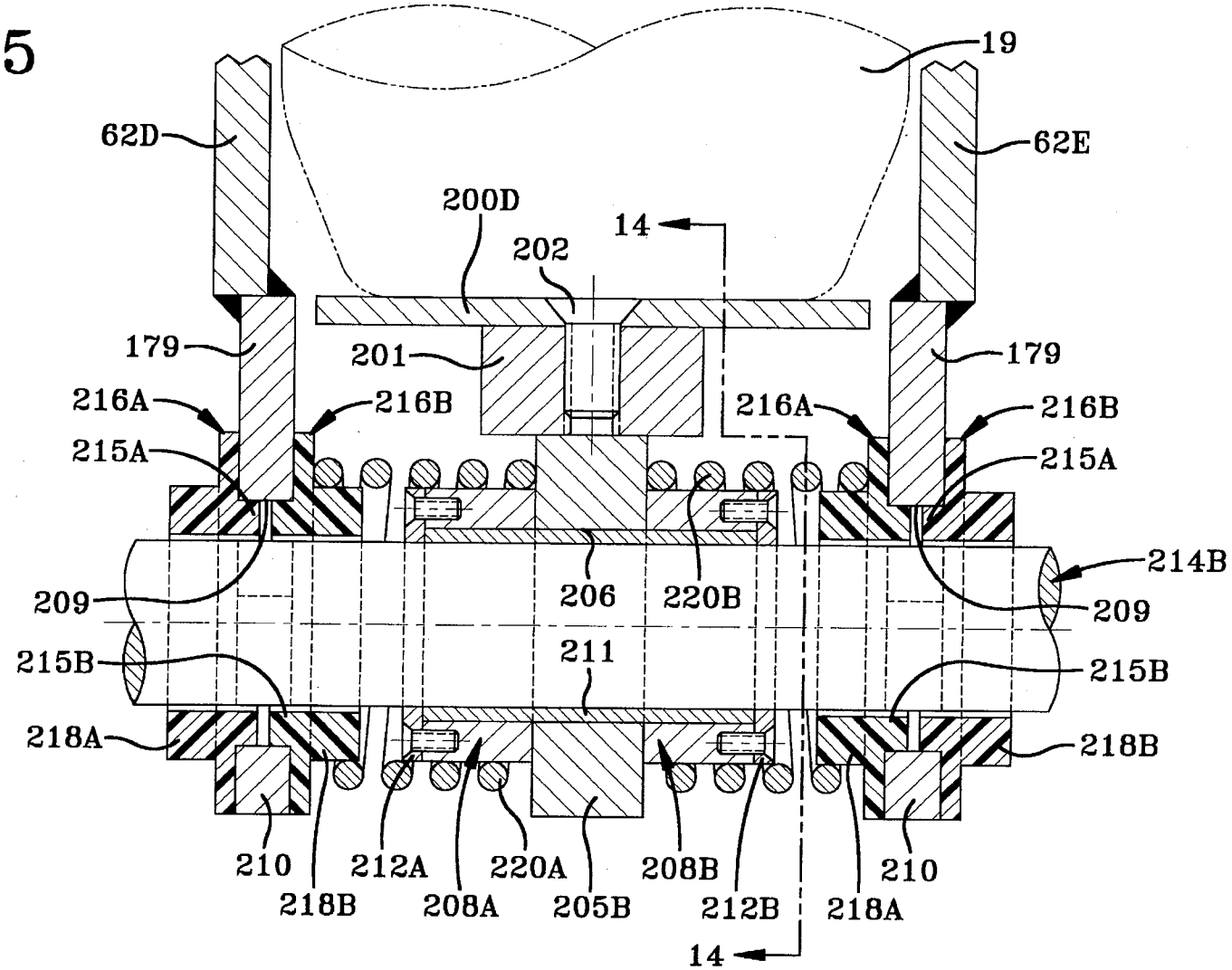
FIG. 15 is an enlarged, longitudinal section taken substantially along line 15—15 of FIG. 14 to depict a fixed carriage for supporting the center-line divider as well as a movable carriage by which the dividers other than the center-line divider are operatively mounted on the adjusting mechanisms in the slide assembly.

It should also be noted that the inclined ramp surface 76 is provided by a plurality of laterally spaced ramp members 200 that can be readily incorporated to operate in conjunction with the foregoing divider adjusting means 105. As represented in FIGS. 13 and 14, the four ramp members 200A through 200D may each be mounted on a longitudinal support bar 201, as by flat head screws 202 (FIGS. 13 and 15). The support bar 201 may, in turn, be secured, as by machine screws 204, to a plurality of mounting brackets 205. The mounting brackets 205 are each provided with an aperture 206 that is aligned with annular spring seats 208A and 208B, one secured to each side of the mounting bracket 205. An aperture 209 may be provided in each extension bracket 210 that is integral with the mounting fins 159 on divider 62C as well as with the mounting fins 179 on dividers 62A, 62B, 62D and 62E, as depicted in FIG. 15. As such, a ramp member 200 is disposed between each divider 62. For example, the ramp segment 200D may be interposed between dividers 62D and 62E.

A sleeve bearing 211 extends axially within the aperture 209 and may be secured by a pair of retainer plates 212A and 212B demountably attached to the mounting bracket 205. As shown, the apertures 209 may be of larger diameter than the interior diameter of the sleeve bearing 211 in order to obviate unnecessary contact of the apertures 209 with the mounting shaft 214 that extends through the sleeve bearing 211.

An annular tenon 215 may extend outwardly in one direction from each spring seat 216 to be received within the aperture 209. As such, each aperture receives two oppositely extending spring seats 216A and 216B. A locating annulus 218 extends axially outwardly in the opposite direction from the tenon 215 on each spring seat 216A and 216B. As such, a locating annulus 218B is disposed in axial opposition to the annular spring seat 208A, and a locating annulus 218A is disposed in axial opposition to the annular spring seat 208B. A locating spring 220A is seated on, and extends between, the locating annulus 218B on spring seat 216A and the opposed spring seat 208A. A similar locating spring 220B is seated on, and extends between, the locating annulus 218A on spring seat 216B and the opposed spring seat 208B. By balancing the springs 220A and 220B, they will serve to assure that the ramp member 200D will be centered between the dividers 62D and 62E irrespective of the lateral separation of the dividers 62D and 62E necessary to accommodate the article 19 that is to pass between the dividers 62D and 62E as the articles slide along the ramp member 200D.

The ramp members 200A, 200B and 200C are similarly mounted between dividers 62A through 62D, and it makes no difference if the divider 62 is carried on a carriage 155 that is affixed to the guide rods 145 or a carriage 175 that is slidable on the guide rods 145. In either situation the ramp members 200 will automatically center between the dividers 62, irrespective of whether the dividers have been subjected to center-line adjustment or lane-width adjustment. tiere, too, the mechanism used to center each ramp member 200 may be replicated to conform to the replication of the divider centering, or laterally adjusting, mechanism and lane-width adjusting mechanism. This replication is permitted because the structural arrangements utilized to achieve all three objectives are, as noted from the foregoing description, totally compatible in their location and operation.

Figure 16:
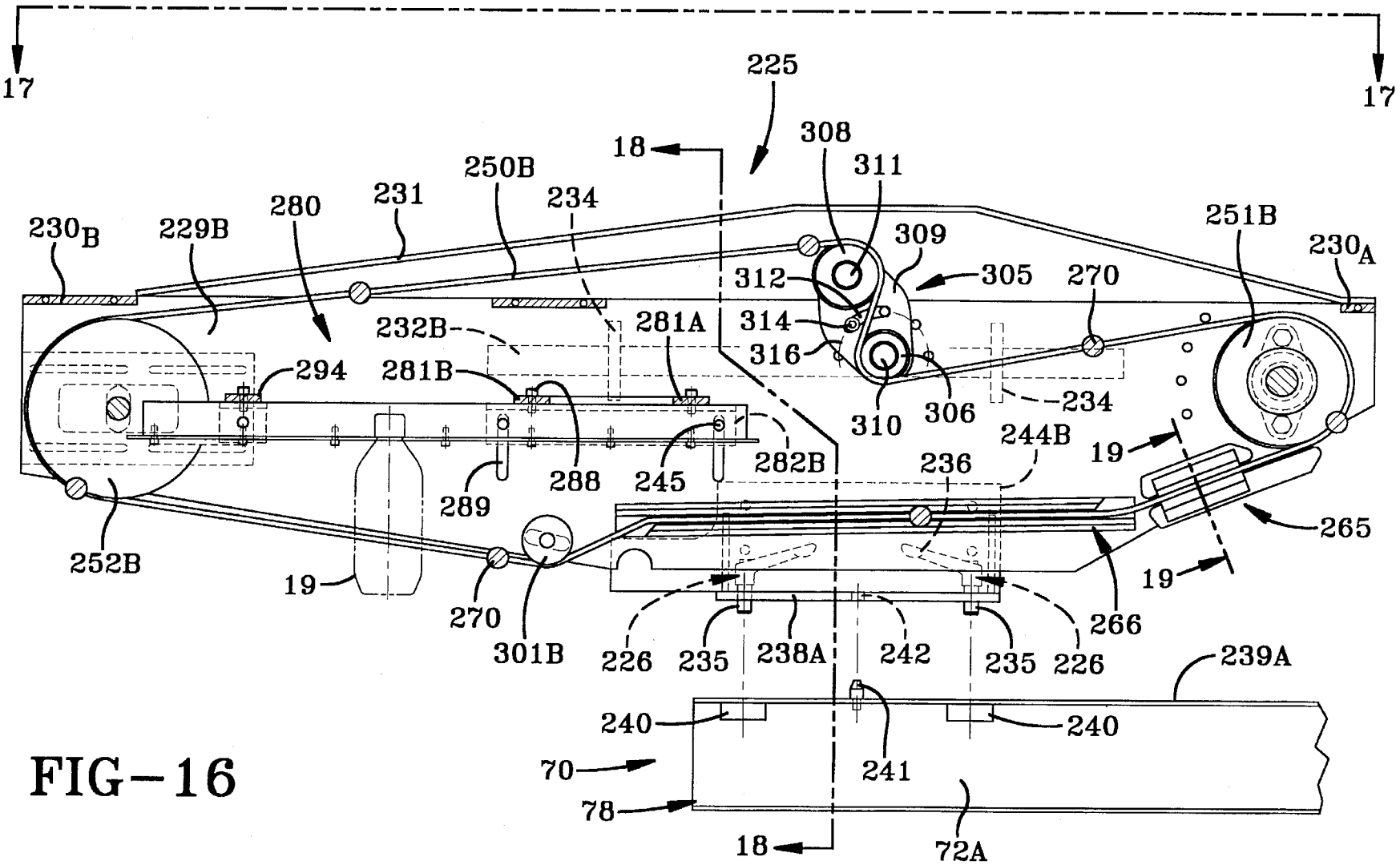
FIG. 16 is an enlarged portion of FIG. 3 depicting the loading head assembly relative to the discharge end of the slide assembly, and by way of a cross reference
Figure 18:
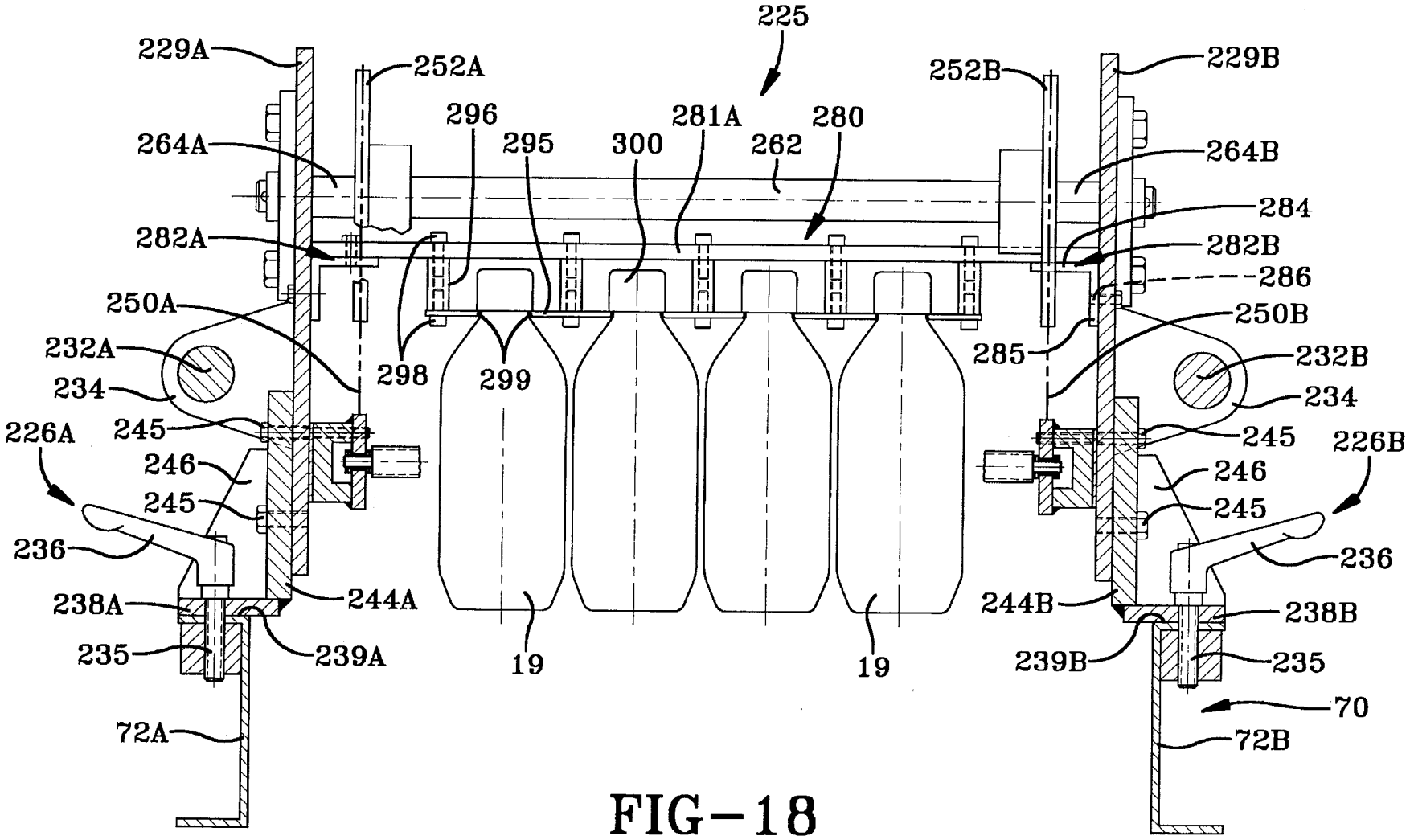
FIG. 18 is an enlarged, transverse section of the loading head assembly taken substantially along line 18—18 of FIG. 16, but with the loading head assembly depicted as being demountably secured to the discharge end of the slide assembly.

As best seen in FIGS. 16 and 18, a loading head assembly 225 is demountably secured to the downstream end 78 of the slide assembly 70, as by a plurality of coupling devices 226. Before describing the means by which to attach the loading head assembly 225 to the slide assembly, it should be recognized that although the loading head assembly 225 must, of necessity, be sturdy, it is preferably made as light as possible so that two people can lift the head assembly 225 on and off the slide assembly 70 with facility and then carry it. The weight of the loading head assembly 225 and the ease with which that assembly can be replaced permits the effective use of a separate loading head assembly 225 for each size article 19 to be packed.

Figure 17:
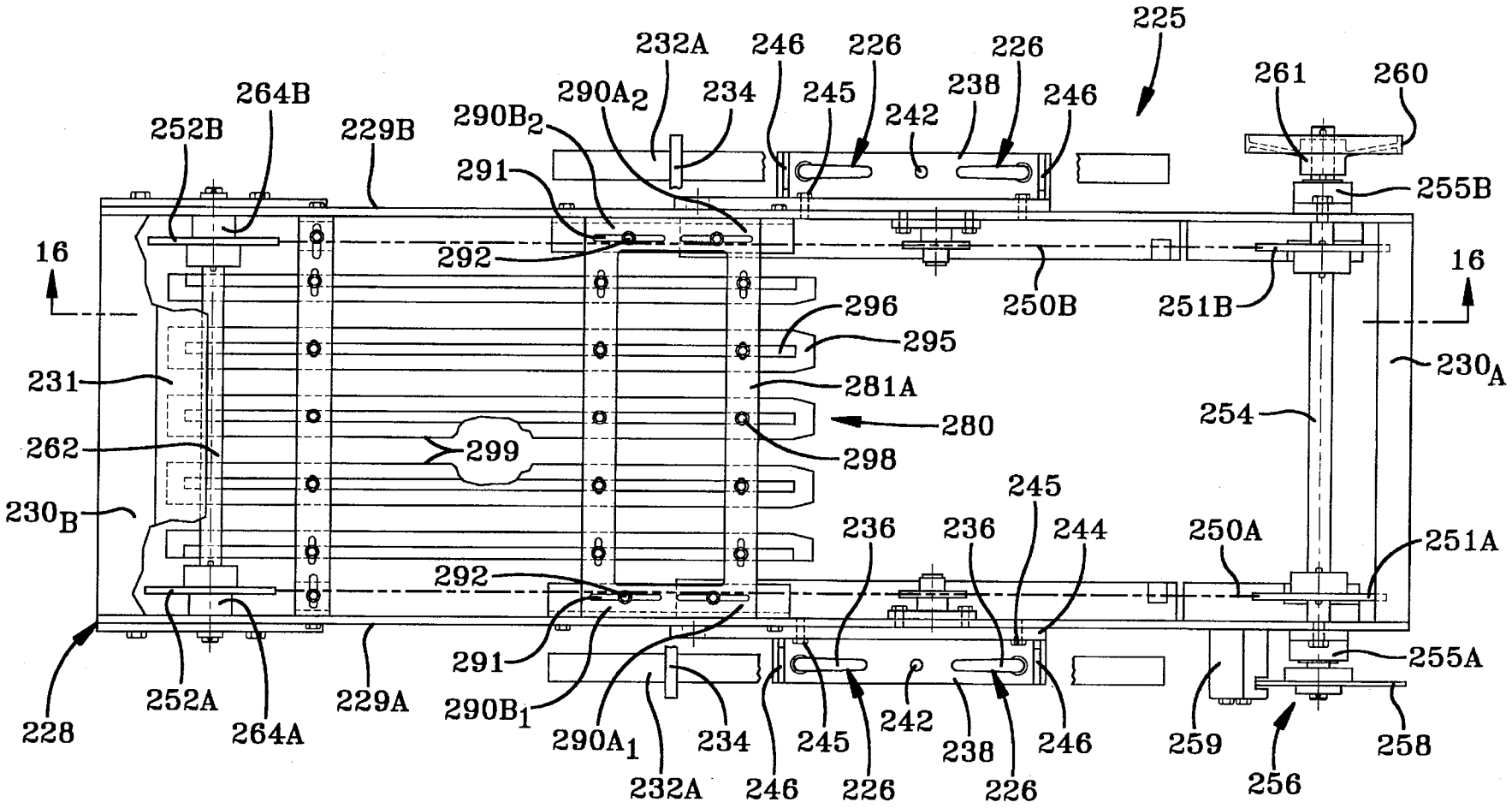
FIG. 17 is a top plan view of a loading head assembly embodying the concepts of the present invention taken substantially along line 17—17 of FIG. 16.

With particular attention to FIG. 17, the loading head assembly 225 has a generally rectilinear outer frame 228 with laterally spaced side plates 229A and 229B that are connected by upstream and downstream end plates $230_A$ and $230_B$, respectively. In order to stabilize the rectangular outer frame 228, and at the same time provide protection to the workers, a cover plate 231 may overlie the entire loading head assembly 225 and be attached to the rectangular frame 228.

An extended, cylindrical lifting handle 232 is mounted to the side plates 229A and 229B by a plurality of mounting brackets 242 that may be secured to the side plates.

The coupling devices 226 by which the loading head assembly 225 may be demountably secured to the slide assembly 70 each have a threaded shaft portion 235 operatively connected to an operating handle portion 236 by an internal, bi-directional ratchet mechanism, not shown, so that the operating handle portion 236 need not be required to rotate through a full three hundred and sixty degrees (360°) in order to secure the loading assembly 225 to the slide assembly 70 or to detach the loading head assembly 225 therefrom. The aforesaid coupling devices 226 are standard items that are readily available. Hence, a detailed description thereof is not deemed to be necessary. Suffice it to say that, as best seen in FIG. 18, the threaded shaft portion 235 of the coupling devices 226 extends downwardly through a mounting plate 238 that is adapted to engage the upper surface 239 on the frame plate 72 at downstream end 78 of the slide assembly 70. Locating the threaded shaft portions 235 for proper engagement with the threaded connecting blocks 240 mounted on the frame plates 72 of the slide assembly 70 is facilitated by aligning pins 241 that extend upwardly from the upper surface of the frame plates 72 to be received in locating bores 242 in the mounting plate 238. An anchor plate 244A and 244B is fastened, as by a plurality of machine screws 245, to the exterior surface of the respective side plates 238A and 238B, and a welded connection, for example, between the mounting plate 238 and the anchor plate 244 may be enhanced by one or more gusset plates 246 that are connected between the mounting and anchor plates 238 and 244, respectively.

Flight chains 250A and 250B are operatively mounted interiorly of the loading assembly 225 on the side plates 229A and 229B, respectively. Each flight chain 250 is reeved around an input sprocket 251 and a return sprocket 252 located, respectively, at the upstream and downstream ends of the input frame 228. The input sprockets 251A and 251B and the return sprockets 252A and 252B—as well as all other hereinafter described sprockets over which the flight chains 250 are reeved—are generally freely rotatable, for a purpose that will be hereinafter more fully described.

The only exception to free rotatability of the flight chains 250 occurs during start-up, or shut-down. As such, the axle 254 for the input sprocket 251 may extend axially outwardly through its bearing block 255A to be operatively connected to a brake device 256 that utilizes a brake disk 258 secured to the axle 254 for selective engagement by a well-known, pneumatically-operated, caliper mechanism 259 mounted on side plate 229A.

The opposite end of axle 254 may extend axially outwardly through bearing block 255B to be operatively connected to a hand-operated wheel 260. The connection between the wheel 260 and the axle 254 is preferably achieved through a well-known clutch mechanism within the hub 261 of the wheel 260 which requires that the wheel 260 be axially translated to effect an operative, driving connection between the wheel 260 and the axle 254.

The axle 262 on which the return sprockets 252A and 252B are mounted is freely rotatable in the bearing blocks 264A and 264B.

An insertion chain guide 265 is mounted on each side plate 229 to engage each flight chain 250 as it leaves the input sprocket 251. As best seen in FIG. 16, the insertion chain guides 265 are each inclined to direct the flight chains 250 downwardly into their individual hold-down chain guides 266.

A series of longitudinally spaced flight bars 270 extend laterally between the laterally spaced flight chains 250A and 250B. The flight bars 270 are longitudinally spaced simultaneously to direct the articles 19 in adjacent files 106 into a numerical grouping that comports with the number of articles in each file 106 to be received within a single carton 15 at the loading station 14. As such, use of the insertion chain guide 265 is mandated to preclude buckling, or kinking, of the flight chains 250 in order to assure that the flight bars 270 will be properly spaced between the articles 19 on the slide assembly 70 to delineate the desired longitudinal grouping of the articles 19 for insertion into the cartons 15.

Figure 20:
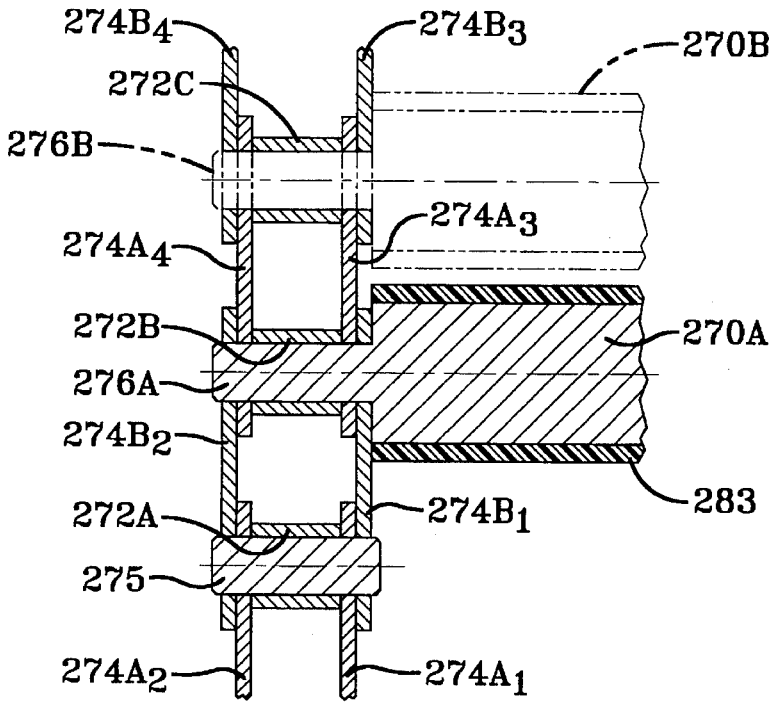
FIG. 20 is a cross section taken substantially along line 20—20 of FIG. 19.

In addition to separation of the articles 19 in each file 106 into the proper number for each carton 15, the flight bars 270 also effect the necessary separation between the successive groups of articles 19 to accommodate for the combined thickness of the contiguous end walls—i.e.: the thickness of the end wall 40D that forms the trailing edge of a preceding carton added to the thickness of the end wall 40C that forms the leading edge of the next successive carton 15, as best seen in FIG. 20.

It should be appreciated that in some situations it may be desirable, if not necessary, for doubling of the flight bars 270. That is, two flight bars rather than a single flight bar will extend laterally, in longitudinal juxtaposition, to effect the desired longitudinal grouping of articles in each file 106. This doubling of the flight bars 270 can be effectively employed when the end walls of the successive cartons 15 combine to a thickness that is greater than one might prefer for a single flight bar. The contiguous doubling of the flight bars 270 is also highly desirable when the articles 19 are sufficiently thin-walled that insertion of a single, relatively large diameter, flight bar might deform, rather than simply separate, successive articles 19. It has been determined that by using double flight bars 270 they will tend to insert singly and then wedgingly rotate to separate the successive articles without distortion of even thin-walled articles.

Irrespective of whether the flight bars 270 are single or doubled, the insertion chain guide 265 is necessary to preclude binding that might result were the chains 250 to buckle, or kink, during insertion of the flight bars 270 between the designated articles 19.

Figure 19:
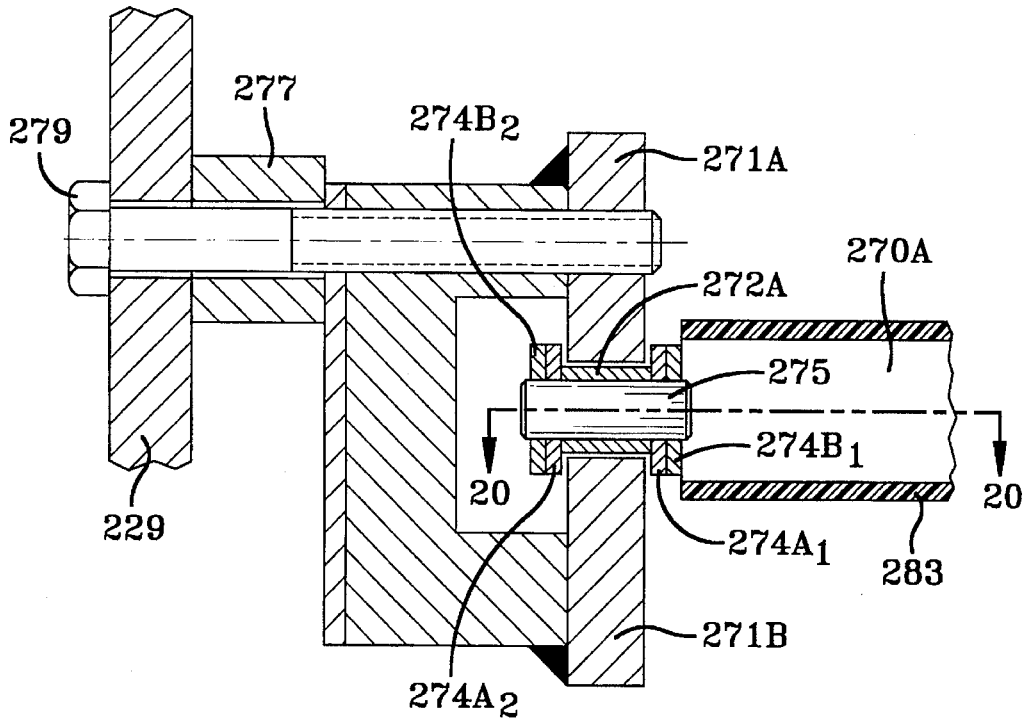
FIG. 19 is an enlarged cross section taken substantially along line 19—19 of FIG. 16.

Chain guides are also commonly available, and they generally comprise (as best seen in FIG. 19) opposed, engaging plates 271A and 271B that contact the rollers 272 between the side links 274 of the flight chains 250. The pins 275 which normally conjoin the rollers and the side links into a chain may be replaced by the reduced connecting end portion 276 of the flight bars 270 as an effective manner by which to mount the flight bars 270. It should also be noted that when the flight bars are doubled, as represented by flight bars 270A and 270B on FIGS. 19 and 20, the end portions 276A and 276B may be substituted for the pins 275 that conjoin successive rollers 272. In any event, the engaging plates 271 may be mounted in a support housing 278 of generally C-shaped cross section that may be attached directly, or by an offset block 277, to the side plates 229 of the loading head frame 228, as by machine screws 279. Also shown on FIGS. 19 and 20 is the fact that the flight bars 270 may, if desired, be covered by a low friction sleeve 283, such as nylon.

Once the flight bars 270 are inserted between the longitudinal grouping of articles 19 it is mandatory that the flight bars remain in situ. This is accomplished by the hold-down chain guides 266 which stabilize the flight chains 250 to preclude dimensional variation between successive flight bars 270 to preserve the grouping of the articles 19 to the proper longitudinal dimension and also to preclude deformation of the articles 19.

As the articles 19 are stabilized in their longitudinal grouping, the support of the articles is transferred from the ramp members 200 in the slide assembly 70 to a transfer structure 280 provided in the loading head assembly 225. The transfer structure 280 is suspended from a series of supporting members 281 that extend laterally between the side plates 229 of the frame 228. As shown, supporting members 281A and 281B may rest on brackets 282 that may be vertically adjustable in the side plates 229A and 229B. As such, the brackets 282 may be in the configuration of an angle iron, one leg 284 of which extends laterally to provide a shelf on which the support member 281 rests. The other leg 285 of the bracket 282 is provided with a threaded bore 286 to receive adjusting machine screws 288 that extend through vertical slots 289 in the side plates 229. The supporting members 281 may also be longitudinally adjustable on the bracket 282 by a similar arrangement wherein the extension arms 290 that have a longitudinal slot 291 to receive the machine screws 292 by which the extension arms 290 may be adjustably fastened along the leg 284 of bracket 282.

A third, but longitudinally downstream, support member 294 may also be adjustably secured to the side plates 229 of the frame 228.

A plurality of laterally extending engaging blades 295 are dependingly carried from the lower edge of hangers 296 that are, in turn, attached to the underside of the support members 281 and 294. As best seen in FIGS. 17 and 18, the hangers 296 may well be longitudinally extending plates, the upper edge of each of which is attached to the support members by cap screws 298. The lower edge of the hangers 296 provide the surfaces against which the engaging blades 295 may be attached, also as by cap screws 298.

The successive engaging blades 295 are of a predetermined width so that the opposed edges 299 of which will engage the articles 19 beneath the cap, or reinforcing neck ring, 300 so that as the articles exit from the downstream end of the ramp members 200 the weight of the successive articles 19 is transferred to the engaging blades 295, as shown in FIGS. 16 and 18.

Figure 21:
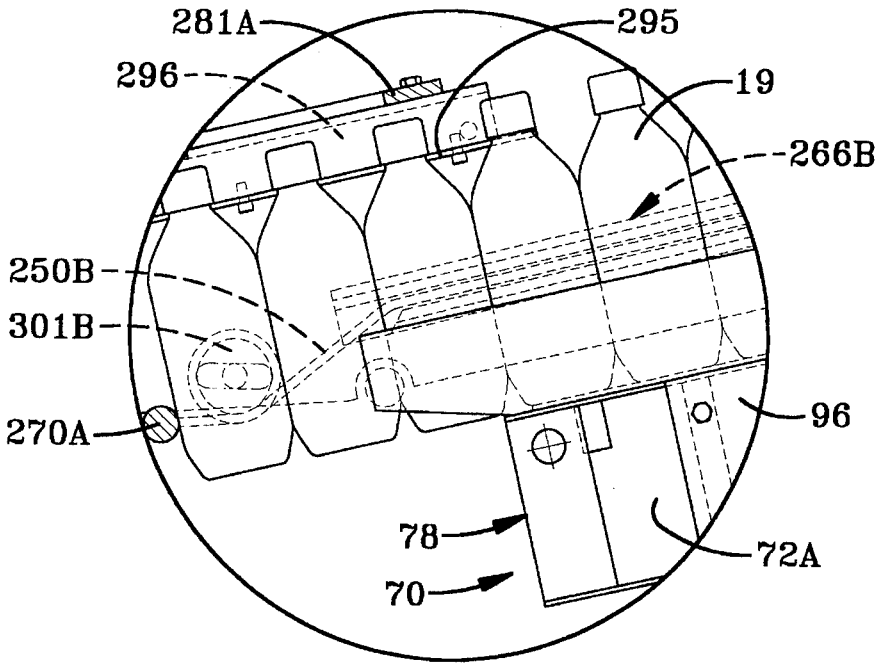
FIG. 21 is that area of FIG. 2 within the chain-line circle identified as "SEE FIG. 21" which has been enlarged for clarity; and, FIG. 22 is that area of FIG. 2 within the chain-line rectangle identified as "SEE FIG. 22" which has been enlarged for clarity.
Figure 22:
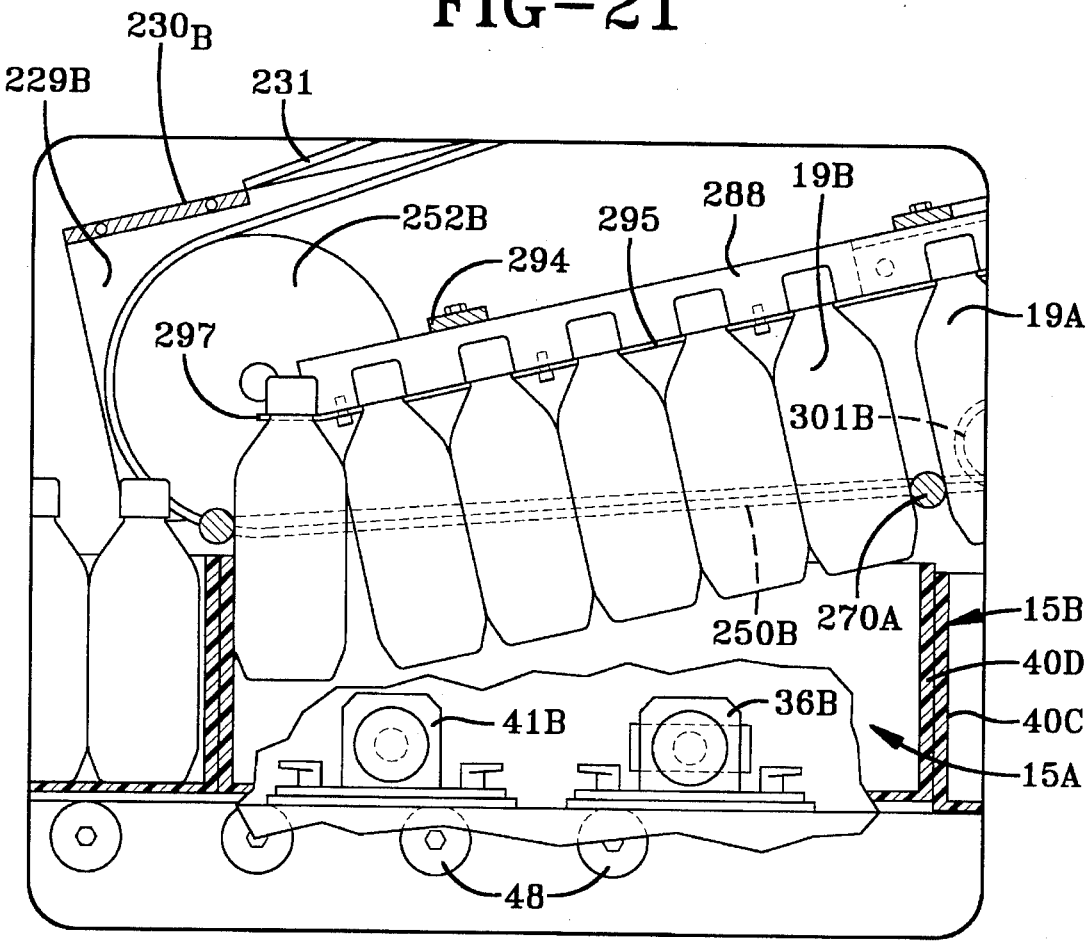

Returning to the description of the path along which the endless flight chains 250 are reeved, it will be observed that as the flight chains 250 exit the hold-down chain guide 266 a freely rotatable splay-inhibiting sprocket 301 effects an abrupt displacement of each flight chain 250 to a level lower than that maintained by the hold-down chain guide 266. The sprocket 301 thus drives the flight bars 270 to their lowest engagement with the articles 19. This movement, as best seen in FIGS. 21 and 22, prevents the successive articles 19A and 19B in successive groupings from swinging away from the grouping and toward an adjacent grouping in a splaying movement that might, if not precluded, cause the last article 19B in a preceding group to engage the end wall 40C on the next successive carton 15B rather that drop into the leading carton 15A. At the same time, displacement of flight bar 270A prevents the first article 19A in the next grouping from splaying forwardly to engage the trailing end 40D of the preceding carton 15A in order to assure that article 19A will properly engage the inner side on the leading wall 40C of the next successive carton 15B, as required to move the cartons across the loading station 14 solely by movement of the articles 19.

The final structure to be described in the loading head assembly 225 is the chain-tension/length adjusting mechanism 305. As shown in FIG. 16, a pair of sprockets 306 and 308 are rotatably mounted on a pivot plate 309. The first sprocket 306 is rotatably mounted on a pivot shaft 310 that is fixed to the side plate 229, and the pivot plate 309 is mounted to swing about the pivot shaft 310. The second sprocket 308 is rotatably mounted on a shaft 311 that is fixed to the pivot plate 309. An arcuate slot 312 penetrates the pivot plate 309 between the first and second sprockets 306 and 308 to receive locking machine screws 314 that extend through the arcuate slot 312 to be threadably received within appropriate bores 315 disposed along a bolt circle 316. Hence, selective rotation of the pivot plate 309 about the pivot shaft 310 effects adjustment of the tension in the flight chain 250 that is reeved in a reverse curve through the sprockets 306 and 308. When the desired tension is achieved, the pivot plate 309 is secured by tightening the locking machine screws 314. In addition to adjusting the tension, the mechanism 305 also serves to accommodate any excess length of the flight chains 250. It must be understood that the length between successive flight bars is determined by the longitudinal dimension of the article grouping to be received in the specific cartons 15 to be packed. Inasmuch as the endless flight chains 250 can only be the exact multiple of the required spacing between successive flight bars 270, the mechanism 305 permits the accommodation of endless chains 250 of differing length on a standard loading head assembly 225.

It should now be appreciated that as the articles 19 slide, by gravity, down the inclined slide assembly 70 they are initially supported on the surface 76 of each ramp member 200, those surfaces 76 having a relatively low coefficient of friction so that as the articles are thus gravity-propelled through the slide assembly 70 they engage the transfer structure 280 by which the articles 19 are vertically supported, but unimpeded in their longitudinal motion, such that the articles 19 supported by the transfer structure 280 engage each successive carton 15 into which the articles 19 are to be packed and impart the sole source of energy required to move that carton 15 across the loading station 14. The gravity-propelled motion of the articles 19 also serves as the sole source of the energy which imparts motion to the flight chains 250 so that they can segregate the articles into discrete groupings which are of the proper longitudinal dimension to allow them to be properly received in each successive carton as they drop off the downstream end of the engaging blades 295, which may be linear to the end, or may, for some applications be curved slightly upwardly at the end, as depicted at 297 in FIG. 22.

To prepare the packing apparatus 10 for start-up, the operator will initially place a carton 15 against the extended finger 42 of the carton locator assembly 41 and then rotate the handle 260 on the loading head assembly 225 until the leading upstream article 19 pressing against one of the flight bars 250 is positioned to engage the inwardly facing side of the wall 40C forming the leading edge on the carton that has been positioned by the carton locator assembly 41. The brake device 256 is then activated to lock the flight chains 250 and thereby hold the articles against movement by gravity. With the articles 19 and the first carton 15 to be loaded thus disposed relative to the loading station 14, and with a succession of cartons 15 on the carton delivery queue 11 and a similar succession of articles 19 on the article orienting and delivery queue 12, the brake devices 36 and 256 as well as the carton locator assembly 41 are released to permit gravity to function, and the packing apparatus 10 begins to operate and continues to do so until it runs out of either articles 19, in which case the cartons 15 are stopped by the carton braking assembly 36 and/or the carton locator assembly 41, or articles 19, in which case the packing apparatus 10 automatically ceases to operate.

While only a preferred embodiment of my present invention is disclosed, it is to be clearly understood that the same is susceptible to numerous changes apparent to one skilled in the art. Therefore, the scope of the present invention is not to be limited to the details shown and described but is intended to include all changes and modifications which come within the scope of the appended claims.

As should now be apparent, the present invention teaches that a packing apparatus embodying the concepts of the present invention not only utilizes the gravitational movement of the articles to propel the cartons across the loading station as well as to pack the cartons, but also that the other objects of the invention can be likewise accomplished.

We claim:

1. An apparatus for continuously packing a plurality of articles into cartons, said apparatus comprising:

a loading station;

said loading station incorporating a plurality of support rollers disposed in longitudinally spaced series:

a belt means freely rotatable across said series of support rollers; and a brake means to adjust the resistance provided said belt to a carton traversing said loading station;

a carton delivery queue for providing a continuous sequence of cartons to said loading station;

means to transport the cartons along said carton delivery queue and to maintain at least the next successive carton in said queue in continuously juxtaposed, longitudinal engagement with any carton on said loading station;

an article orienting and delivery queue for longitudinally aligning a plurality of articles in the desired side-by-side relationship;

a slide assembly included in said article orienting and delivery queue;

said slide assembly being inclined to assure that the articles will be gravity-propelled to a sufficient degree longitudinally to traverse said slide assembly and be received at said loading station;

flight means longitudinally to space the articles in the predetermined grouping required for that carton at said loading station; and, said gravity-propelled, descending movement of the articles and the resulting engagement of the articles with a carton at said loading station effecting synchronous movement of the carton along said loading station relative to the movement of the articles along said slide assembly so that the articles will be continuously deposited within the carton.

2. An apparatus, as set forth in claim 1, further comprising:

means demountably to secure said loading head to said slide assembly.

3. An apparatus, as set forth in claim 1, wherein said belt means at said loading station further comprises:

a high friction engaging surface on said belt means;

said engaging surface elevated above said the level of said carton delivery queue to a sufficient degree that a carton received on said engaging surface will not engage the means to transport a carton along said carton delivery queue but to a degree the will not impede the free transfer of a carton on said carton delivery queue to said engaging surface.

4. An apparatus, as set forth in claim 1, wherein:

said slide assembly has a downstream end; and, said loading station has a carton locator assembly selectively to engage a carton received on said loading station and to maintain the carton so engaged in a precise relation to the downstream end of said slide assembly.

5. An apparatus, as set forth in claim 2, further comprising:

transfer means supported in said loading head assembly;

said transfer means supporting the articles as they leave said loading head assembly to engage and propel a carton on said loading station.

6. An apparatus, as set forth in claim 2, further comprising:

said transfer means supported from said loading head assembly and extending longitudinally beyond said slide assembly and over at least a portion of said loading station.

7. An apparatus for continuously packing a plurality of articles into cartons, said apparatus comprising:

a loading station;

a carton delivery queue for providing a continuous sequence of cartons to said loading station;

means to transport the cartons along said carton delivery queue and to maintain at least the next successive carton in said queue in continuously juxtaposed, longitudinal engagement with any carton on said loading station;

an article orienting .and delivery queue for longitudinally aligning a plurality of articles in the desired side-by-side relationship;

a slide assembly included in said article orienting and delivery queue;

said slide assembly being inclined to assure that the articles will be gravity-propelled to a sufficient degree longitudinally to traverse said slide assembly and be received at said loading station;

flight means longitudinally to space the articles in the predetermined grouping required for that carton at said loading station;

said gravity-propelled, descending movement of the articles and the resulting engagement of the articles with a carton at said loading station effecting synchronous movement of the carton along said loading station relative to the movement of the articles along said slide assembly so that the articles will be continuously deposited within the carton; and a loading head assembly supported from said slide assembly;

said flight means being supported in said loading head assembly;

said gravity-propelled movement of the articles through said loading head assembly operating said flight means.

8. An apparatus, as set forth in claim 7, wherein said flight means further comprises:

at least one flight chain;

flight bars secured to said flight chain;

said flight bars being longitudinally spaced at a distance corresponding to the dimension of the specific longitudinal grouping of articles that can be received in the cartons to be presented at said loading station.

9. An apparatus, as set forth in claim 8, wherein said flight means further comprises:

input sprocket means and return sprocket means rotatably mounted in said loading head assembly;

said flight chain being reeved about at least said input and said return sprocket means; and, a brake means operatively attached to one said sprocket means selectively to preclude movement of said flight chain.

10. An apparatus, as set forth in claim 8, further comprising:

an insertion guide to direct said flight bars between the articles at said specific, predetermined, longitudinal spacing to effect the desired grouping of the articles.

11. An apparatus, as set forth in claim 10, further comprising:

input sprocket means and return sprocket means rotatably mounted in said loading head assembly;

said flight means being reeved about at least said input and said return sprocket means;

said insertion guide maintaining a linear orientation of said flight means between said input sprocket means and the location at which said insertion guide effects insertion of said flight bars between the articles to effect said desired grouping of the articles.

12. An apparatus, as set forth in claim 7, further comprising:

a hold-down guide to maintain said flight rod inserted between the articles between the location at which said flight rod was inserted between the articles until the articles are sequentially deposited in the cartons at said loading station.

13. An apparatus, as set forth in claim 12, further comprising:

an anti-splay sprocket means located downstream of said hold-down guide;

said anti-splay sprocket means effecting an abrupt displacement of said flight bar below the level at which said flight bar was maintained by said hold-down guide in order to assure separation of the articles as a juxtaposed engagement of successive cartons passes beneath said abruptly displaced flight bar.

14. An apparatus, as set forth in claim 9, wherein said flight means further comprises:

handle means operatively attached to one said sprocket means selectively to position said flight bar.

15. An apparatus for continuously packing a plurality of articles into cartons, said apparatus comprising:

a loading station;

a carton, delivery queue for providing a continuous sequence of cartons to said loading station;

means to transport the cartons along said carton delivery queue and to maintain at least the next successive carton in said queue in continuously juxtaposed, longitudinal engagement with any carton on said loading station;

an article orienting and delivery queue for longitudinally aligning a plurality of articles in the desired side-by-side relationship;

a slide assembly included in said article orienting and delivery queue;

said slide assembly being inclined to assure that the articles will be gravity-propelled to a sufficient degree longitudinally to traverse said slide assembly and be received at said loading station;

flight means longitudinally to space the articles in the predetermined grouping required for that carton at said loading station;

said gravity-propelled, descending movement of the articles and the resulting engagement of the articles with a carton at said loading station effecting synchronous movement of the carton along said loading station relative to the movement of the articles along said slide assembly so that the articles will be continuously deposited within the carton;

divider means in said slide assembly to delineate longitudinal files of articles to be received in the cartons at said loading station; and, means to effect simultaneous, incremental, lateral translation of said divider means without changing the lateral spacing between said divider means without removing said divider means from said slide assembly.

16. An apparatus, as set forth in claim 15, further comprising:

laterally spaced frame plates in said slide assembly;

laterally extending first adjusting shaft means rotatably mounted in said frame plates;

means to prevent said first adjusting shaft means from moving laterally with respect to said frame plates;

a shift member extending longitudinally of said slide assembly;

said first adjusting shaft means operatively engaging said shift member to effect lateral displacement of said shift member in response to rotation of said first adjusting shaft means;

laterally extending second adjusting shaft means rotatably mounted in said shift member;

means to prevent said second adjusting shaft means from moving laterally with respect to said shift member;

a plurality of laterally extending guide rods secured to move laterally with said shift member;

first carriage means secured to selected guide rods;

a reference divider means carried on said first carriage means;

second carriage means;

means to secure said second carriage means to said second adjusting shaft means such that said second carriage means will move laterally with said second adjusting shaft means as said second adjusting shaft means moves laterally with said shift member;

file delineating divider means spaced laterally on either side of said reference divider means; and, individual file delineating divider means secured to said second carriage means.

17. An apparatus, as set forth in claim 16, further comprising:

means simultaneously to effect equal incremental adjustment of the lateral spacing between said divider means.

18. An apparatus, as set forth in claim 17, wherein:

said means to secure said individual file delineating divider means to said second adjusting shaft means comprises thread means;

said file delineating divider means includes laterally adjacent divider means that are separated from said reference divider means by only one file;

said file delineating divider means also includes laterally outboard divider means that are separated from said reference divider means by more than one file;

said thread means on one side of the reference divider being of one hand and the thread means on the other side of the reference divider being of the opposite hand; and, the pitch of said thread means by which said second adjusting shaft means is secured to any laterally outboard divider means is equal to the pitch of the thread means by which the second adjusting shaft means is secured to any laterally adjacent divider means multiplied by the number of files between said reference divider means and said laterally outboard divider means.

19. An apparatus, as set forth in claim 18, further comprising:

a plurality of inclined ramp members in said slide assembly;

said ramp members having an upper side and an underside;

said upper side presenting a ramp surfaces along which the gravity-propelled articles may slide;

said ramp members disposed between said divider means;

a mounting bracket secured to the underside of each said ramp member;

an extension bracket presented from each said divider means;

mounting shaft means extending laterally between said frame plates;

said extension bracket and said mounting brackets having apertures therethrough slidingly to receive said mounting shaft means; and, spring means circumscribing said mounting shaft means and interposed between said extension bracket and said mounting brackets to center each said ramp member between adjacent divider means.

* * * * *